US006412459B1

(12) United States Patent
Takahashi et al.

(10) Patent No.: US 6,412,459 B1
(45) Date of Patent: Jul. 2, 2002

(54) VALVE TIMING CONTROLLER FOR INTERNAL COMBUSTION ENGINE

(75) Inventors: Tatsuhiko Takahashi, Kobe; Atsuko Hashimoto, Tokyo, both of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/859,818

(22) Filed: May 18, 2001

(30) Foreign Application Priority Data

Nov. 2, 2000 (JP) ..... 2000-336470

(51) Int. Cl.[7] ..... F02D 13/02; F01L 1/34
(52) U.S. Cl. ..... 123/90.15; 123/90.17
(58) Field of Search ..... 123/90.15, 90.16, 123/90.17, 90.18, 90.31

(56) References Cited

U.S. PATENT DOCUMENTS 5,628,286 A * 5/1997 Kato et al. ..... 123/90.15
6,085,706 A * 7/2000 Kadowaki et al. ..... 123/90.15
6,161,511 A * 12/2000 Hashimoto ..... 123/90.15
6,260,524 B1 * 7/2001 Wachi ..... 123/90.15

FOREIGN PATENT DOCUMENTS

JP 9-217609 8/1997
JP 9-256878 9/1997

* cited by examiner

*Primary Examiner*—Weilun Lo
(74) *Attorney, Agent, or Firm*—Sughrue Mion, PLLC

(57) ABSTRACT

There is disclosed a valve timing controller having excellent response and used with an internal combustion engine. The controller performs a corrective control operation according to the oil pressure control characteristics of the actually mounted valve. The valve timing controller comprises an intake cam, an exhaust cam, an actuator for varying the phase of rotation of one of the cams relative to the crankshaft of the engine, an oil pressure control valve for applying oil pressure on the actuator, and a control means for controlling the valve timing by controlling the oil pressure output from the oil pressure control valve. The oil pressure output is controlled by controlling the current through the solenoid in the oil pressure control valve. The two cams are driven by the crankshaft of the engine. The intake cam opens and closes the intake valve. The exhaust cam opens and closes the exhaust valve. The control means detects the currents supplied into the solenoid to activate the actuator in different operating conditions of the engine. The characteristics of the oil pressure control valve are detected from the difference in the current value under these different operating conditions. An amount of control current is determined.

13 Claims, 15 Drawing Sheets

VALVE TIMING CONTROLLER FOR INTERNAL COMBUSTION ENGINE

BACKGROUND OF THE INVENTION

1. Field of the Invention

The present invention relates to a valve timing controller for an internal combustion engine and, more particularly, to a valve timing controller for controlling the timing of operation of the intake valves and the exhaust valves of an internal combustion engine.

2. Description of the Related Art

In an internal combustion engine, the required valve timing for air intake and exhaust is varied according to the operating conditions. In the past, almost every internal combustion engine has a camshaft that is driven by a crankshaft via a timing belt or the like. The timing at which the intake and exhaust valves are opened and closed is fixed regardless of the angular position of the crankshaft. In recent years, however, variable valve timing systems have been adopted to improve the output of the internal combustion engine and to provide higher fuel economy and lower emissions. Accordingly, various techniques regarding valve timing have been disclosed.

One of these techniques is disclosed in Japanese patent laid-open No. 256878/1997. In this disclosed technique, the phase of the rotating output shaft of an internal combustion engine is displaced to drive a camshaft. Valve timing of at least one of intake and exhaust valves is adjusted. The valve timing is detected from the phase difference between the output shaft of the engine and the camshaft. Target valve timing is established from the operating conditions of the engine. The control gain of a valve timing-adjusting means is so set that the detected timing agrees in phase with the target valve timing. The displacement speed of the phase of the rotating camshaft is found from the transition of the actual valve timing. The displacement speed of this phase of rotation is compared with a reference value. The control gain is corrected such that the speed difference between them is reduced down to zero. In this way, displacement speed variations are absorbed. Response and convergence are improved.

More specifically, during adjustment of the valve timing, if the actual valve timing deviates from the target valve timing, a proportional value is created from the deviation. Based on this proportional value and on a derivative value calculated from this deviation, a duty factor for compensating the response delay is sent to an oil pressure control valve. Subsequently, a proportional value and a derivative value are similarly found from the deviation at some instant of time and thus another duty factor is found and sent to the oil pressure control valve. The duty factor is maintained until the deviation of the actual valve timing from the target valve timing becomes less than a given value. While this duty factor is being maintained, the variation in the actual valve timing between two points is found. Also, the time in which this variation occurs is found. The displacement speed of the phase of rotation is found from the variation and the time. This displacement speed is compared with a reference speed value. If the displacement speed is higher than the reference value, the duty factor for compensation of the response delay is set to a smaller value. If it is lower, the duty factor for compensation of the response delay is set to a larger value.

Japanese patent laid-open No. 217609/1997 discloses a technique for accurately controlling valve timing using a valve timing control mechanism that rotates relative to any one of the output shaft of an internal combustion engine and a camshaft driven by the output shaft within a given angular range. The valve timing control mechanism is operated according to the difference between the actual value of the angular distance between the output shaft and the camshaft and a target value. The angular distance is so controlled as to agree with the target value. If the deviation of the actually measured value from the target value does not vary, a correcting value for the valve timing control mechanism is so set as to reduce the deviation. In this way, valve timing can be accurately controlled without being affected by manufacturing tolerances.

Conventional valve timing controllers for internal combustion engine are constructed in this way. Of these conventional valve timing controllers s in the technique disclosed, for example, in the above-cited Japanese patent laid-open No. 256878/1997, a duty factor found at some instant of time is sent to an oil pressure control valve and maintained to detect the displacement speed of the phase of rotation. Where the deviation of the actual valve timing from target valve timing is found at regular intervals of time, if a proportional value and a derivative value are found from the deviation, and if control is provided using a duty factor found from these proportional value and derivative value, then responsiveness may deteriorate. Also, the detected displacement speed of the phase of rotation is compared with a reference value. The duty factor is corrected according to the difference. Consequently, only the initial response delay that produces a difference between the actual valve timing and the target valve timing is corrected. It cannot be said that sufficient correction is made. Hence, sufficient responsiveness may not be obtained.

SUMMARY OF THE INVENTION

The present invention has been made to solve the foregoing problems.

It is an object of the present invention to provide a valve timing controller which is for use with an internal combustion engine and which makes a correction adapted for the characteristics of the actually mounted oil pressure control valve to provide stable response in spite of variations in flow rate characteristics due to manufacturing tolerances, the valve timing controller being further characterized in that it can compensate for variations in flow rate characteristics by a control operation.

A valve timing controller built in accordance with the present invention and for use with an internal combustion engine having a crankshaft comprises: an intake cam driven by the crankshaft of the engine and acting to open and close intake valves; an exhaust cam driven by the crankshaft of the engine and acting to open and close exhaust valves; a valve timing-varying means mounted in a rotation transfer path between said crankshaft and at least one cam selected from the intake cam and the exhaust cam to vary the phase of rotation of said one cam relative to the crankshaft; a driving means for driving the valve timing-varying means; and a control means for controlling an amount of control over the driving means. This control means detects a difference of the amount of control over the driving means to cause the valve timing-varying means to operate in a desired manner under different operating conditions of the internal combustion engine. The amount of control over the driving means is determined according to the difference of the amount of control.

In one feature of the invention, the difference of the amount of control under a different operating condition of the engine is detected when the difference between an actually operated amount of motion to vary the valve timing and a target amount of motion to vary the valve timing satisfies a given condition.

In another feature of the invention, the control means learns amounts of control under different operating conditions of the engine. The amount of control over the driving means is determined from a difference of this learned value.

In a still other feature of the invention, the control means stores plural characteristics of the driving means. One of the plural characteristics is selected according to the difference of the amount of control under a different operating condition of the engine. Thus, the amount of control over the driving means is determined.

In a yet additional feature of the invention, the control means selects a poor response characteristic or control value from plural characteristics or control values until the amount of control over the driving means is determined from the difference of the amount of control under a different operating condition of the engine. The selected characteristic or control value is used as an amount of control over the driving means.

In an additional feature of the invention, there are further provided detecting means for detecting the angular position of said one cam relative to the crankshaft and an arithmetic means for calculating target position of the angular position of said one cam relative to the angular position of the crankshaft according to the operating conditions of the engine. The control means performs proportional and derivative control operations according to the difference between the detected relative position and the target position and sets plural proportional and derivative control values. One of the proportional and derivative values is selected according to the difference of the amount of control under a different operating condition of the engine. Thus, the amount of control over the driving means is determined.

In a still other feature of the invention, there are further provided detecting means for detecting the angular position of said one cam relative to the crankshaft and an arithmetic means for calculating target position of the angular position of said one cam relative to the angular position of the crankshaft according to the operating conditions of the engine. The control means performs an integral operation according to the difference between the detected relative position and the target position and sets plural integral control values. One of the different integral control values is selected according to the difference of the amount of control under a different operating condition of the engine. Thus the amount of control over the driving means is determined.

In a still further feature of the invention, the control means stores plural different characteristics of the driving means. The control means interpolates one of the plural different characteristics according to the difference of the amount of control under a different operating condition of the engine. Thus, the amount of control over the driving means is calculated.

In a further additional feature of the invention, the amount of control over the driving means is calculated from each midway value obtained by interpolating the plural characteristics or control values until the amount of control over the driving means is set from the difference of the amount of control under a different operating condition of the engine.

In a yet other feature of the invention, there are provided a detecting means for detecting the angular position of said one cam relative to the angular positions of the crankshaft and an arithmetic means for calculating the target position of the angular position of said one cam relative to the crankshaft according to the operating condition of the internal combustion engine. The control means performs proportional and derivative control operations according to the difference between each detected relative position and the target position. The control means sets plural proportional and derivative value and interpolates one of the plural different characteristics according to the difference of the amount of control under a different operating condition of the engine. Thus, the amount of control over the driving means is calculated.

In a yet additional feature of the invention, there are further provided a detecting means for detecting the position of said one cam relative to the angular position of the crankshaft and an arithmetic means for calculating target position of the angular position of said one cam relative to the angular position of the crankshaft according to the operating conditions of the engine. The control means performs an integral control operation according to the difference between each detected relative position and the target position. The control means sets plural integral control values and interpolates one of the plural different integral control values according to the difference of the amount of control under a different operating condition of the engine. Thus, the amount of control over the driving means is calculated.

Other objects and features of the invention will appear in the course of the description thereof, which follows.

DESCRIPTION OF THE PREFERRED EMBODIMENTS

Embodiment 1

Figure 1:
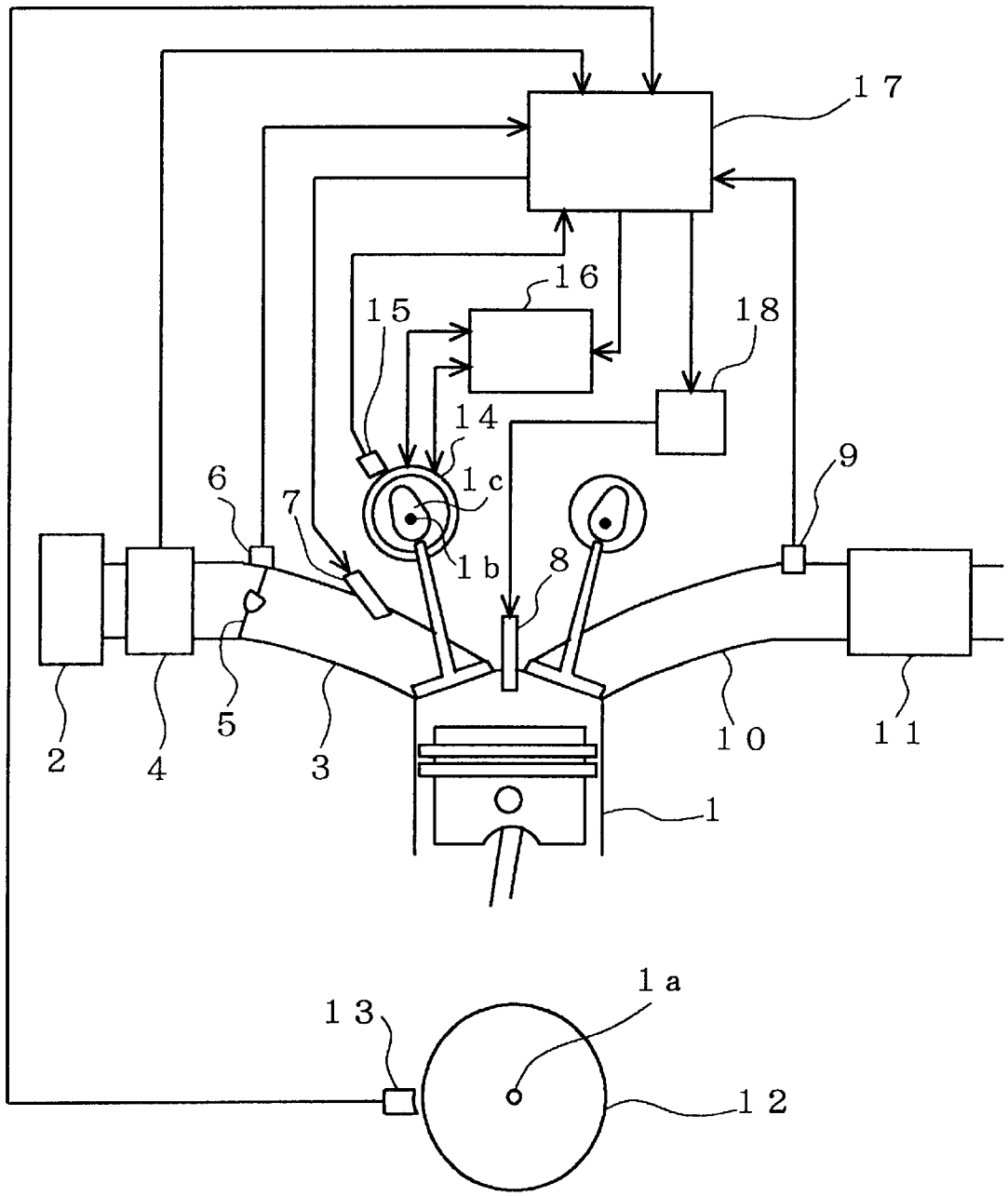
FIG. 1 is a diagram illustrating the structure of a valve timing controller in accordance with Embodiment 1 of the present invention, the valve timing controller being for use with an internal combustion engine.
Figure 2:
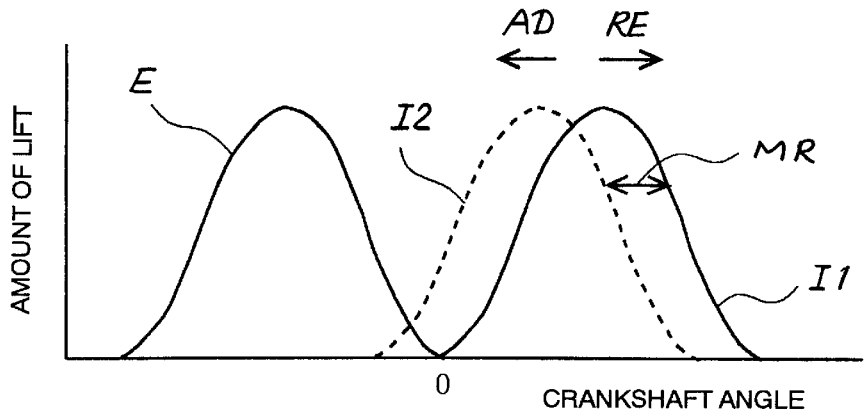
FIG. 2 is a characteristic diagram illustrating valve timing given by the valve timing controller in accordance with Embodiment 1 of the invention, the valve timing controller being for use with an internal combustion engine.
Figure 3:
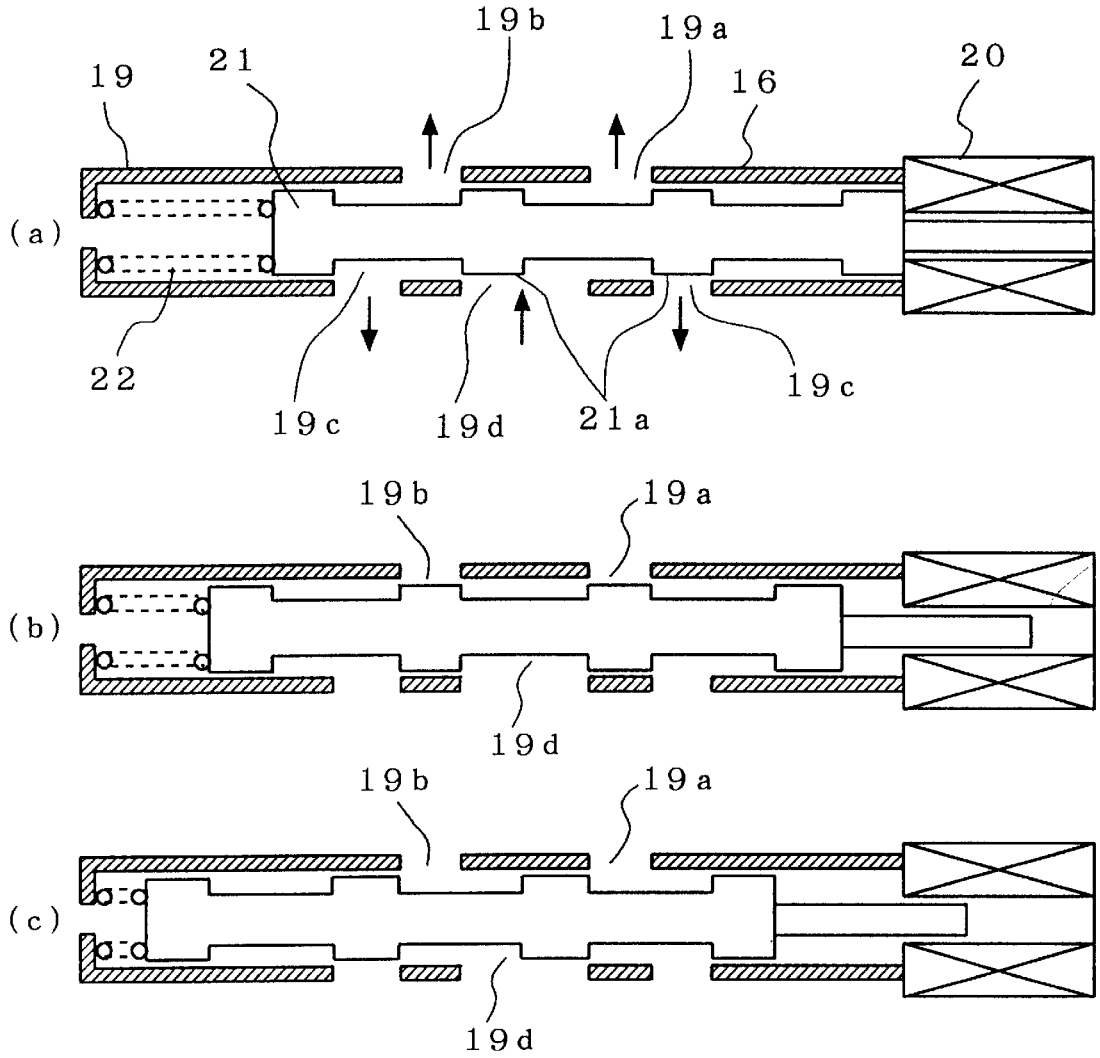
FIG. 3 is a cross-sectional view illustrating the structure and operation of an oil pressure control valve included in the valve timing controller in accordance with Embodiment 1 of the invention, the valve timing controller being for use with an internal combustion engine.
Figure 4:
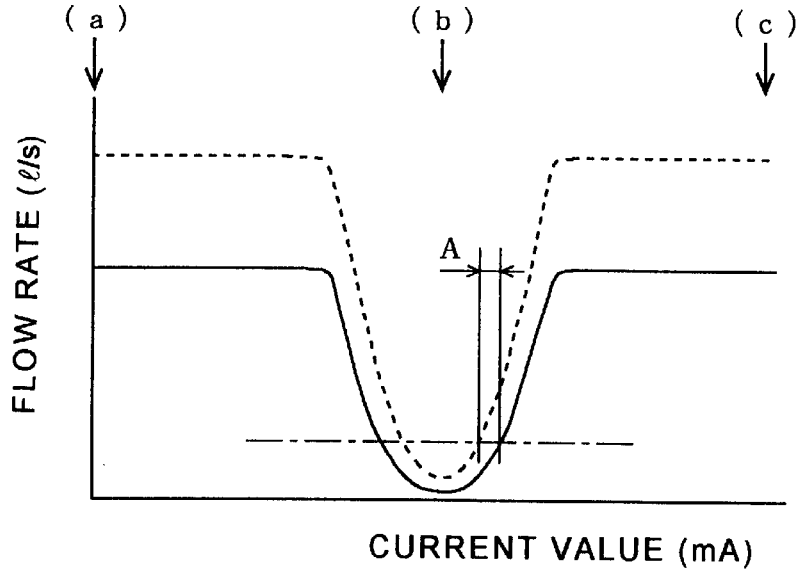
FIG. 4 is a flow rate characteristic diagram of the oil pressure control valve included in the valve timing controller in accordance with Embodiment 1 of the invention, the valve timing controller being for use with an internal combustion engine.
Figure 5:
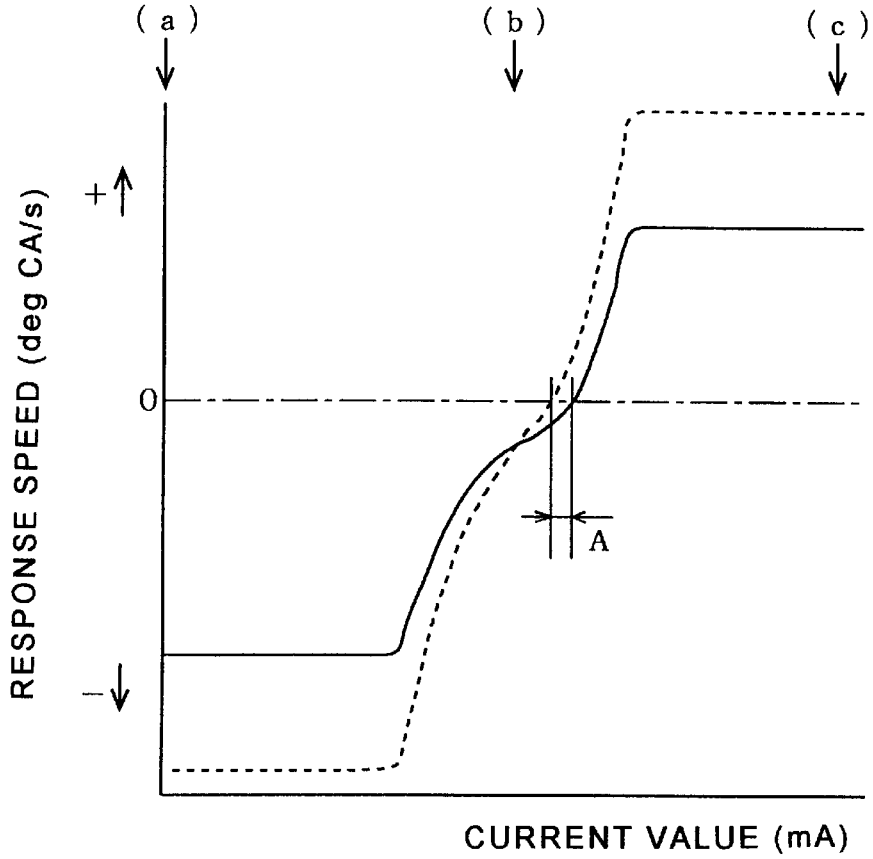
FIG. 5 is a characteristic diagram illustrating the responsiveness of a control mechanism included in the valve timing controller in accordance with Embodiment 1 of the invention, the valve timing controller being for use with an internal combustion engine.
Figure 6:
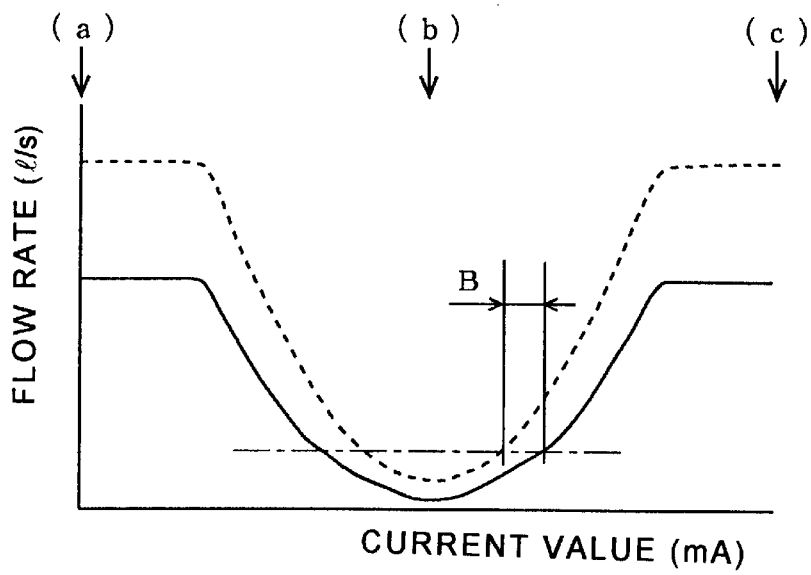
FIG. 6 is a flow rate characteristic diagram of the oil pressure control valve included in the valve timing controller in accordance with Embodiment 1 of the invention, the valve timing controller being for use with an internal combustion engine.
Figure 7:
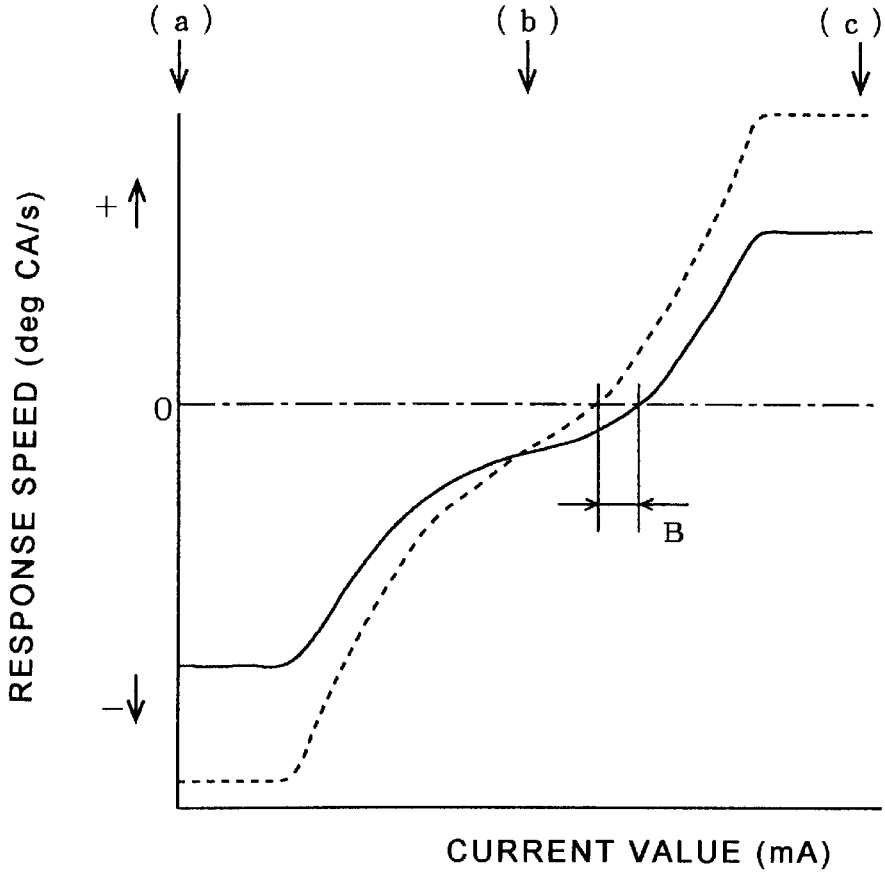
FIG. 7 is a characteristic diagram illustrating the responsiveness of a control mechanism included in the valve timing controller in accordance with Embodiment 1 of the invention, the valve timing controller being for use with an internal combustion engine.

FIGS. 1–15 illustrate a valve timing controller for use with an internal combustion engine, the valve timing controller being built in accordance with Embodiment 1 of the present invention. FIG. 1 shows the structure of the valve timing controller mounted to the internal combustion engine. FIG. 2 is a characteristic diagram illustrating valve timing. FIG. 3 is a diagram illustrating the structure and operation of an oil pressure control valve. FIGS. 4 and 6 are flow rate characteristic diagrams of the oil pressure control valve. FIGS. 5 and 7 are characteristic diagrams illustrating the responsiveness of a valve timing control mechanism. FIGS. 8–11 are flowcharts illustrating control processing against which control processing of the present invention is compared, the former control processing not using the present invention. FIGS. 12–15 are flowcharts illustrating control processing in accordance with the present invention.

The structure of the internal combustion engine equipped with the valve timing controller is described next by referring to FIG. 1. The internal combustion engine is generally indicated by reference numeral 1 in FIG. 1 and has an intake passage 3 in which an air cleaner 2 is mounted. An airflow sensor 4 measures the amount of air taken into the engine 1. A throttle valve 5 adjusts the amount of intake air to control the output of the engine 1. A throttle opening sensor 6 detects the opening of the throttle valve 5. An injector 7 supplies an amount of fuel matched to the amount of intake air. A spark plug 8 ignites the air-fuel mixture within the combustion chamber of the engine 1. An $O_2$ sensor 9 is mounted in an exhaust passage 10 extending from the engine 1 and detects the amount of oxygen remaining in the exhaust gas. A three-way-catalyst 11 is used to clean the exhaust gas.

The internal combustion engine 1 further includes a crankshaft 1*a* on which a sensor plate 12 is mounted for detection of the angular position of the crankshaft. This sensor plate 12 cooperates with a crankshaft angle sensor 13 to detect the angular position of the crankshaft 1*a*. The engine 1 further includes a cam 1*c* on which a sensor plate 14 for detecting the angular position of the cam is mounted. The sensor plate 14 cooperates with a cam angle sensor 15 to detect the angular position of the cam 1*c*. An oil pressure control valve (OCV) 16 acts as a driving means as described later. An actuator (not shown) acting as a valve timing-varying means is mounted to a camshaft 1*b* of the engine 1. The oil pressure control valve 16 controls oil pressure and oil flow rate supplied into the actuator (not shown) to thereby control the position of the cam 1*c* on the camshaft 1*b* relative to the crankshaft 1*a*, the cam 1*c* being driven by the crankshaft 1*a*. The angular position (cam phase) of the cam 1*c* relative to the crankshaft 1*a* is controlled within a given range. A control means 17 controls the phase of the cam according to the operating condition of the engine 1 and performs various control operations for the engine 1. An ignition system 18 applies an ignition voltage to the spark plug 8.

In the internal combustion engine 1 constructed in this way, rotation of the crankshaft 1*a* is transmitted to the camshaft 1*b* via a timing belt, a chain, or the like. For example, the camshaft 1*b* has a sprocket or pulley (not shown) on which an actuator is mounted. The angular positional relation between the camshaft 1*b* and the cam 1*c* can be varied within a given range. Therefore, the angular positional relation between the crankshaft 1*a* and the cam 1*c*, which rotate at a ratio of 1:2, can be varied within a given range. The valve timing of at least one of the intake and exhaust valves relative to the crankshaft angle can be controlled. This valve timing is controlled by oil pressure and oil flow rate supplied from the oil pressure control valve (OCV) 16.

In FIG. 2, the amount of lift of the intake valve is plotted against the angular position of the crankshaft 1*a* where the exhaust valve is fixed while the intake valve is variable. The curve E shows the amount of lift of the exhaust valve and curve I1, I2 show the amount of lift of the intake valve. The timing of the intake valve can be varied from the curve I1 indicated by the solid line to the curve I2 indicated by the broken line. The curve I1 indicates the most retarded angular position at which the valve overlap with respect to the exhaust valve is minimal. The curve I2 indicates the most advanced angular position at which the overlap is greatest. Accordingly, advancing the valve timing increases the valve overlap. Retarding the valve timing reduces the valve overlap. The valve timing can be retained at any desired position between the most retarded angular position and the most advanced angular position. In FIG. 2, an arrow AD shows the direction for advancing angular position and an arrow RE shows the direction for retarding angular position, and an arrow MR shows the movable range between the most advanced position and the most retarded position of the intake valve.

FIG. 3 shows the structure and operation of the oil pressure control valve (OCV) 16 acting as the driving means. The control valve 16 comprises a housing 19, an electromagnetic solenoid 20 mounted at one end of the housing 19, a spool 21 moved within the housing 19 by the electromagnetic solenoid 20, an d a spring 22 for biasing the spool 21 in one direction. The housing 19 is provided with plural ports 19*a*–19*d*. The spool 21 has lands 21*a*. The spool 21 is moved so that its lands 21*a* close or open the ports 19*a*–19*c*, thus controlling oil pressure on the actuator. The amount of oil can be controlled according to the positions and the area of the openings. The port 19*a* supplies oil pressure in a direction to retard the valve timing. The port 19*b* supplies oil pressure in a direction to advance the valve timing. The port 19*c* drains off the pressure. The port 19*d* supplies the oil pressure.

FIG. 3(*a*) indicates the state of OCV 16 according to the most retarded position, FIG. 3(C) indicates the state of the OCV 16 according to the most advanced position and FIG. 3(*b*) indicates the state of OCV 16 according to the center position between the most retarded position and the most advanced position.

FIG. 4 shows the flow rate characteristics of this oil pressure control valve (OCV) 16. The flow rate supplied from the ports 19*a* and 19*b* is plotted against the value of the current flowing through the electromagnetic solenoid 20. When the spool 21 is in the most retarded position shown in FIG. 3(*a*), the flow rate is at position (a) of FIG. 4. When the spool is at the center position shown in FIG. 3(*b*), the flow rate is at position (b) of FIG. 4. When the spool is at the most advanced position shown in FIG. 3(*c*), the flow rate is at position (c) of FIG. 4. FIG. 3(*a*) shows the state according to the most retarded position in which the current through the electromagnetic solenoid 20 is minimal. The spool 21 is biased toward the solenoid 20 by the force of the spring 22. The ports 19*a* and 19*d* are placed in communication with each other, supplying oil into the angle retard chamber in the actuator (not shown). The valve timing is at the most retarded position of the intake valve indicated by the curve I1 in FIG. 2.

Conversely, FIG. 3(*c*) shows the state according to the most advanced position in which the current through the electromagnetic solenoid 20 is greatest. The spool 21 has been moved to the side of the spring 22 by overcoming the force of the spring 22. The ports 19*b* and 19*d* are placed in communication with each other. Oil is supplied into the angle advance chamber in the actuator (not shown). The valve timing is at the most advanced angular position of the intake valve indicated by the curve I2. FIG. 3(*b*) shows the state according the center position in which the current through the electromagnetic solenoid 20 assumes an intermediate value. The ports 19*a* and 19*b* are both closed. Oil is neither supplied to, nor discharged from, the actuator. The valve timing is maintained at the center position between the most retarded angular position and the most advanced angular position.

If the value of the current through the electromagnetic solenoid 20 is maintained at a given value, the position of the spool 21 can be controlled so that the port 19*a* or 19*b* has a desired opening. The amount of oil supplied into the actuator can be controlled. Variation in the position of the actuator when the value of the current through the electromagnetic solenoid 20 is varied is detected as valve timing by the cam angle sensor 15. Variation in the position between two points during operation is detected as a speed. This is expressed as a response speed against the value of the current through the electromagnetic solenoid 20. The results are shown in FIG. 5. Thus, the characteristics of the response speed of the valve timing system to the current value are expressed. The positions (a), (b), and (c) of FIG. 5 correspond to the states or positions (a), (b), and (c), respectively, of FIGS. 3 and 4.

An oil pump (not shown) is driven by the internal combustion engine 1 and supplies oil pressure into the actuator (not shown) via the oil pressure control valve (OCV) 16. When the amount of delivery from the oil pump increases, the oil pressure increases. The flow rate characteristics of the control valve 16 varies from the characteristics indicated by the solid line of FIG. 4 to the characteristics indicated by the broken line. This increase in oil pressure varies the response speed of the actuator. The response speed varies from the characteristics indicated by the solid line in FIG. 5 to the characteristics indicated by the broken line. Therefore, when the rotating speed of the engine 1 increases, the amount of delivery from the oil pump increases and so the response speed characteristics of the actuator vary.

The control means 17 detects the valve timing, i.e., the actual amount of advanced angle, from the output from the crankshaft angle sensor 13 and from the output from the cam angle sensor 15. The control means 17 receives signals indicating the operating conditions of the internal combustion engine 1 such as the rotational speed and the packing efficiency and calculates a target amount of advanced angle. The control means controls the value of the current through the control valve 16 so that the actual amount of advanced angle agrees with the target amount of advanced angle, thus controlling the valve timing. The current value at which the actual amount of advanced angle agrees with the target amount of advanced angle is learned as a holding current learning value. This holding current learning value is used as a reference value. The valve timing is controlled according to the deviation from the reference value.

Statically, this holding current learning value is coincident with the current value when the response speed is zero in FIG. 5. With respect to the valve timing, the intake valve, for example, is pressed against the cam by the valve spring and so the cam is urged toward the retarded angle side by the frictional force produced when the cam slides on the valve. Therefore, in order to bring the actual amount of retarded angle into agreement with the amount of target advanced angle, a slight amount of oil needs to be supplied to the advanced angle side to balance it against the frictional force produced by the sliding movement on the valve. The current value obtained when the oil flow rate giving this balance is the actual dynamic holding current learning value. Accordingly, the holding current learning value varies with variation of the rotational speed of the engine 1. The difference between the static current value and the dynamic current value is indicated by A in FIGS. 4 and 5. The value of this difference A is varied by the rotational speed.

The characteristics of the control valve 16 are varied by the manufacturing tolerances and for other reasons. For example, with respect to the flow rate characteristics, the characteristics shown in FIG. 4 vary to the characteristics shown in FIG. 6. The gradient of the flow rate change relative to the current variation varies. If the flow rate characteristics vary, the characteristics of the response shown in FIG. 5 vary to the form shown in FIG. 7. Where the gradient of the flow rate characteristic curve and the gradient of the response characteristic curve vary in this way, the holding current learning value varies with varying the rotational speed. The value of A shown in FIGS. 4 and 5 changes to B as shown in FIGS. 6 and 7, and a relation A<B holds. Accordingly, when the rotational speed varies, the value of B varies at a greater rate than the value of A. In the present invention, the value of the current through the electromagnetic solenoid 20 is determined according to the variation in the holding current learning value due to the characteristic variations among individual products in this way. Variations that are characteristic variations among individual products are absorbed. This permits stable control. In the description given below, control not utilizing the present invention and control using the present invention are compared, and the features of the invention are described.

Figure 8:
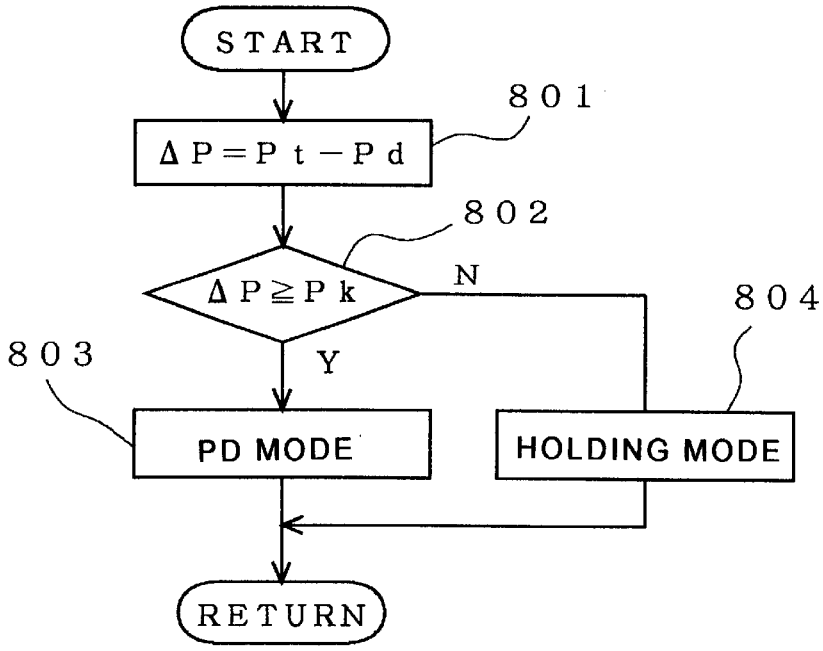
FIG. 8 is a flowchart illustrating processing against which processing of the valve timing controller in accordance with Embodiment 1 of the invention is compared, the valve timing controller being for use with an internal combustion engine.

FIGS. 8, 9, 10, and 11 are flowcharts illustrating control processing performed without making use of the present invention. Each process step is carried at given timing under control of the control means 17. FIG. 8 illustrates processing for judging the mode. In step 801, the control means 17 calculates a target amount of advanced angle Pt according to the operating condition of the internal combustion engine 1 as mentioned previously. The control means also calculates the actual amount of advanced angle Pd from the values detected by the crankshaft angle sensor 13 and the cam angle sensor 15, respectively, and computes the difference ΔP between them. In step 802, a decision is made as to whether this difference ΔP is more than a given value PK. If the difference ΔP is more than the given value PK, control proceeds to step 803, where the mode is judged to be the proportional-and-derivative (PD) control mode. If the difference ΔP is less than the given value PK, control proceeds to step 804, where the mode is judged to be a holding mode. The given value PK is set to such a value that neither the drivability nor the emission is affected if the valve timing varies. The given value is about 1 degree in terms of the angular position of the crankshaft 1*a*.

Figure 9:
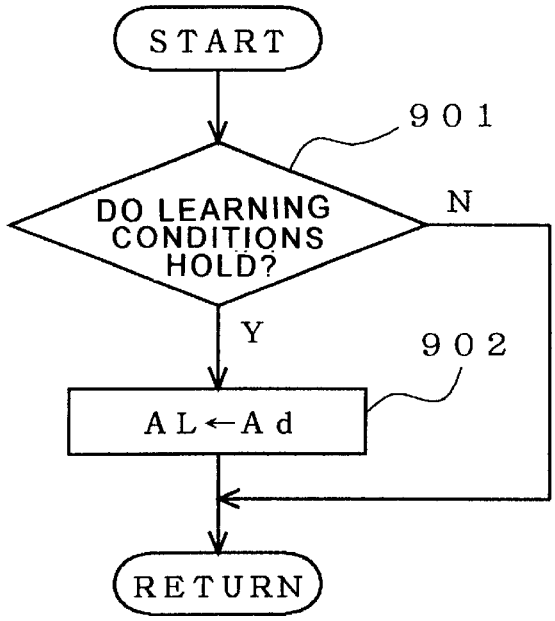
FIG. 9 is a flowchart illustrating processing against which processing of the valve timing controller in accordance with Embodiment 1 of the invention is compared, the valve timing controller being for use with an internal combustion engine.

FIG. 9 illustrates processing for learning about the holding current. In step 901, a decision is made as to whether holding current learning conditions hold. This decision is made, depending on whether the mode is the holding mode in which the actual amount of advanced angle is coincident with the target amount of advanced angle and on whether the integral value of control (described later) is in a stable state. If it is judged that the learning conditions hold, the current value Ad at this time is stored in memory as a holding current learning value AL (step 902). If the result of the decision made in step 901 is that the learning conditions do not hold, the routine is ended, and control returns to the first step. The holding current learning value AL is stored in a backup RAM included in the control means 17. If the battery is disconnected, the value is kept stored unless the backup power supply is disconnected.

Figure 10:
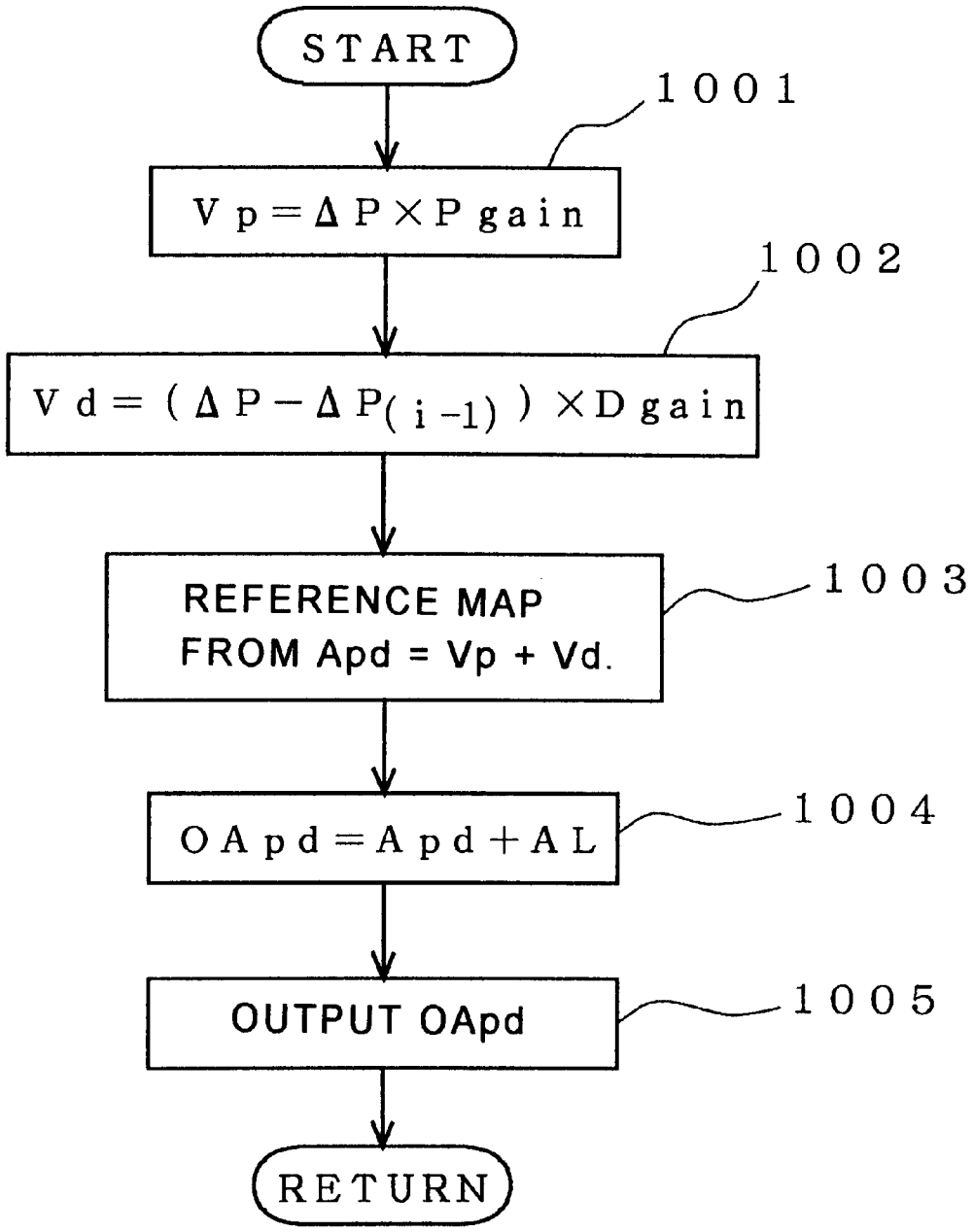
FIG. 10 is a flowchart illustrating processing against which processing of the valve timing controller in accordance with Embodiment 1 of the invention is compared, the valve timing controller being for use with an internal combustion engine.

FIG. 10 illustrates processing performed when the flowchart of FIG. 8 judges that the mode is the proportional-and-derivative (PD) control mode. Instep 1001, the difference ΔP between the actual amount of advanced angle and the target amount of advanced angle is multiplied by a proportional gain Pgain to thereby find a proportional value Vp. Preset values of the proportional gain Pgain are stored in the ROM of the control means 17. In step 1002, the difference between the difference ΔP between the actual amount of advanced angle and the target amount of advanced angle and the previous value of the difference ($\Delta P_{i-1}$) is calculated, and the resultant difference is multiplied by a derivative gain Dgain, thus finding a derivative value Vd ($Vd=(\Delta P-\Delta P_{i-1})\times Dgain$). The previous value of the difference ($\Delta P_{i-1}$) is a value of the difference ΔP calculated previous time, the difference ΔP being calculated at every given timing. Preset values of the derivative gain Dgain are stored in the ROM of the control means 17 in the same way as the proportional gain.

In step 1003, the proportional value Vp and the derivative value Vd are summed up (Vp+Vd). The control means interpolates, or makes reference to, an angle advance speed-current value characteristic map, based on the sum value (Vp+Vd) of the reference value Vp and the derivative value Vd. Thus, a target current difference Apd is found. With respect to the used angle advance speed-current value characteristic map, the response speed plotted against the current value as shown in FIGS. 5 and 7 is set as a deviation value from the holding current learning value. A value corresponding to the oil pressure control valve 16 having medium characteristics is set, or a value satisfying the responsiveness of the valve timing control using medium values of the characteristic is set and stored in memory. In step 1004, the holding current learning value AL in step 902 is added to the target current difference Apd, thus giving rise to a current value to be supplied to the oil pressure control valve 16. In step 1005, this target current value is delivered as a target current value OApd.

Figure 11:
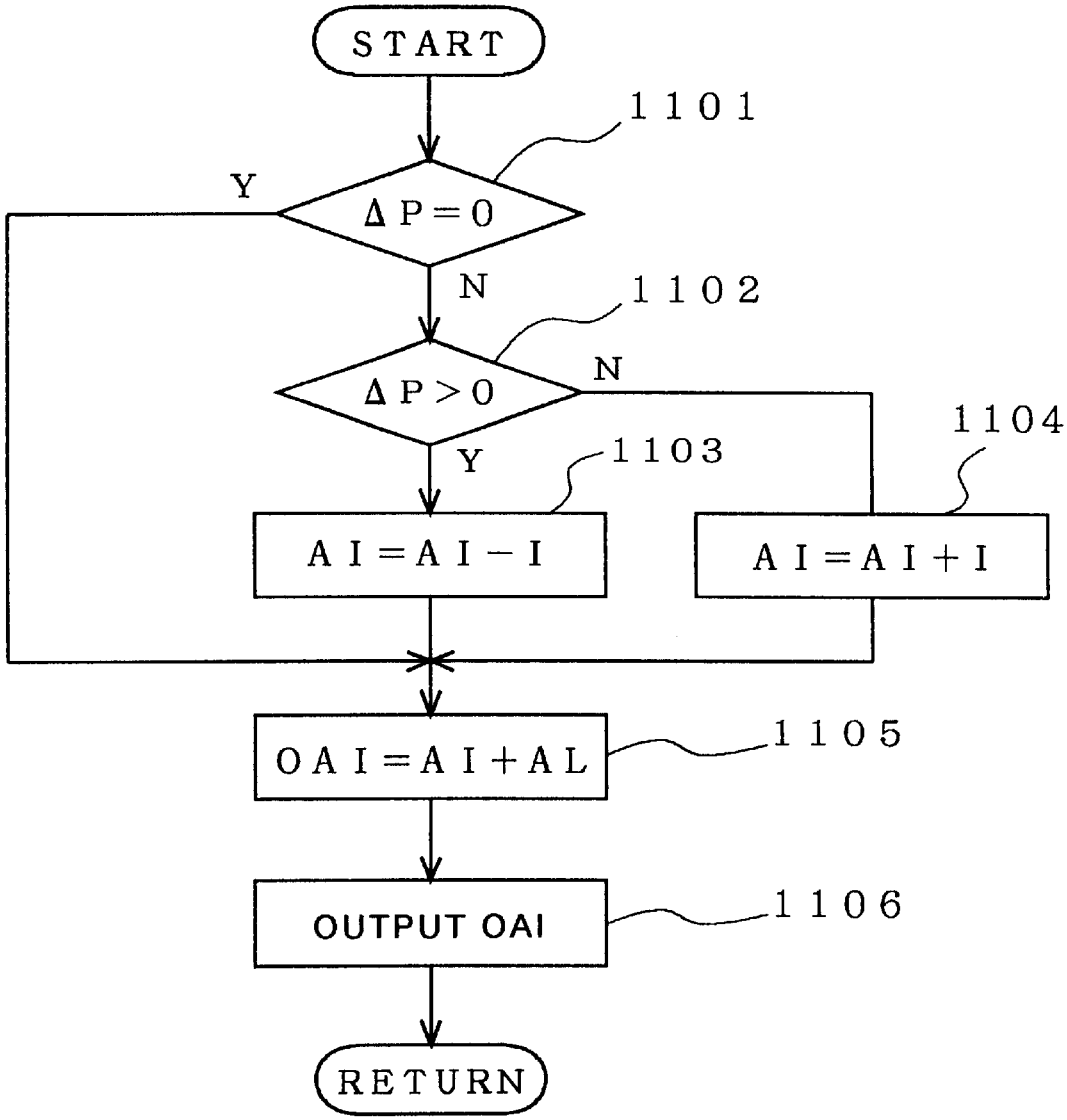
FIG. 11 is a flowchart illustrating processing against which processing of the valve timing controller in accordance with Embodiment 1 of the invention is compared, the valve timing controller being for use with an internal combustion engine.

FIG. 11 illustrates processing performed when the control means judges that the mode is the holding mode in the flowchart of FIG. 8. In step 1101, a decision is made as to whether the difference ΔP between the actual amount of advanced angle and the target amount of advanced angle is zero or not. If it is zero, it follows that the actual amount of advanced angle is coincident with the target amount of advanced angle at that current value. Therefore, it is not necessary to modify the current value. Consequently, the integral value AI does not need to be updated. If they are not coincident, a decision is made as to whether the difference ΔP is greater than zero (step 1102). If it is greater than zero, an integral value I is subtracted from the integral value AI (step 1103). If the result of the decision made in step 1102 is that the difference ΔP is smaller than zero, control goes to step 1104, where the integral value I is added to the integral value AI. In step 1105, the holding current learning value AL is added to the integral value AI to find a target current value OAI. In step 1106, the value is sent to the oil pressure control valve 16.

With respect to the angle advance speed-current value characteristic map used in the control processing of FIG. 10, a value corresponding to the oil pressure control valve 16 having medium characteristics (i.e., the midway value between the characteristics indicated by the solid lines in FIGS. 5 and 7) is set, or a value satisfying the responsiveness of the valve timing control is set using a product showing medium characteristics is set. Therefore, if the actually mounted oil pressure control valve 16 has a greater gradient of characteristic curve as shown in FIG. 5 (e.g., a product having a characteristic curve close to the upper limit), and if the calculated target current value is produced as an output, the overshoot or undershoot will be increased because the actual response speed is higher than the response speed calculated by the control means 17. If the actually mounted control valve has a milder gradient of characteristic curve as shown in FIG. 7 (e.g., a product having a characteristic curve close to the lower limit), and if the calculated target current value is delivered, then the actual response speed is lower than the response speed calculated by the control means 17 and so the response speed will drop.

In this way, the control not utilizing the present invention has the aforementioned problem. Therefore, in the present invention, the following control processing is performed. FIGS. 12–15 are flowcharts illustrating control processing performed by making use of the invention. Like process steps are indicated by like reference numerals in various figures including FIGS. 8–11 already used and thus those components which have been already described will not described below.

Figure 12:
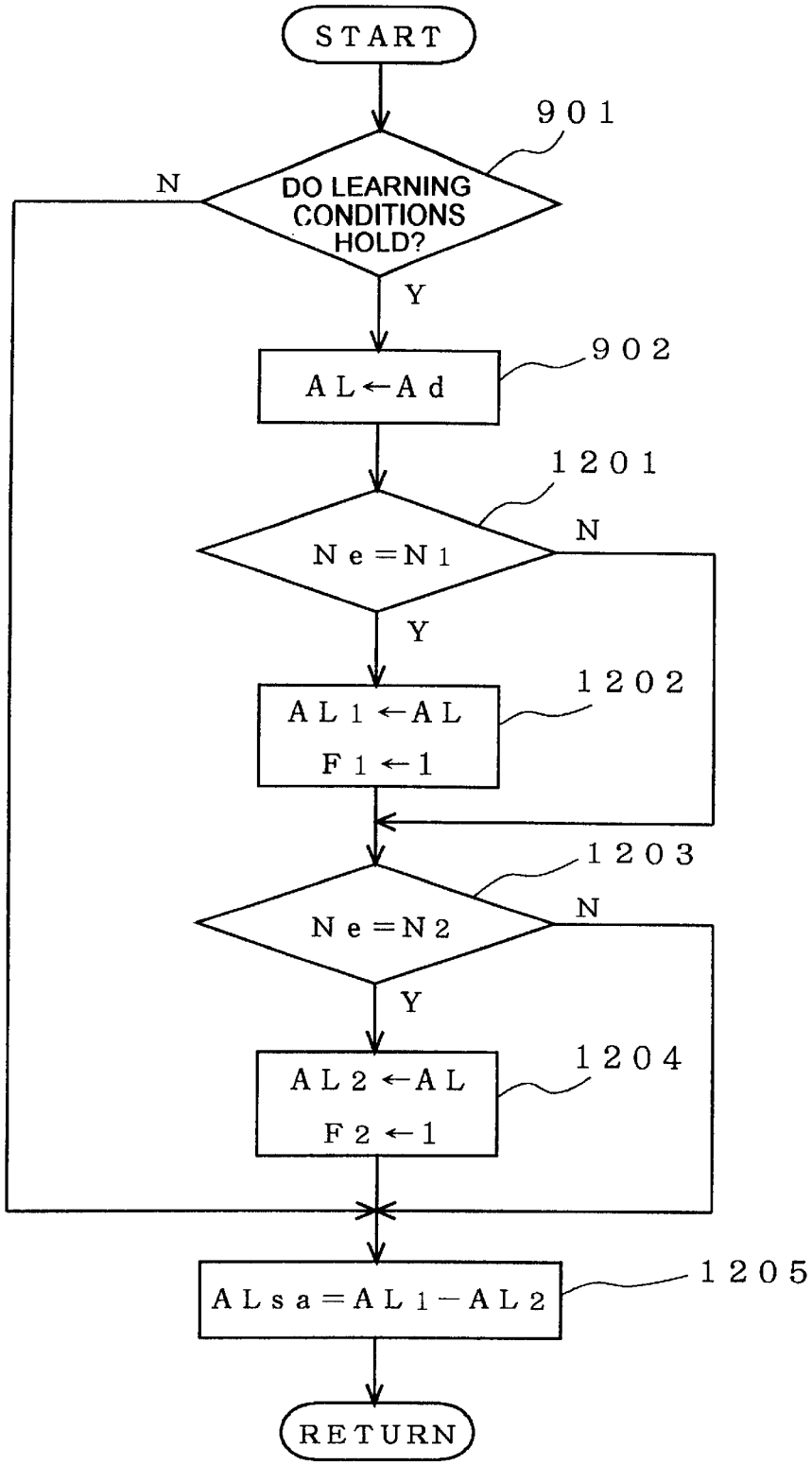
FIG. 12 is a flowchart illustrating control of a valve timing controller in accordance with Embodiment 1 of the invention, the valve timing controller being for use with an internal combustion engine.

FIG. 12 illustrates holding current learning processing. The concept of the present invention is embodied in the processing of FIG. 9. In FIG. 12, a decision is made as to whether holding current-learning conditions hold (step 901). If the conditions hold, control proceeds to step 902, where the holding current is learned, and then a decision is made as to whether the rotating speed Ne of the internal combustion engine 1 is coincident with a first given rotational speed N1 (step 1201). The first given rotational speed is set, for example, to a rotational speed of about 1500 rpm at which the oil pressure is low and a valve timing control operation is started. If the rotational speed is coincident with the first given rotational speed N1, this holding current learning value is learned as a holding current learning value AL1 at the first given rotational speed (step 1202). At the same time, a flag F1 indicating that learning is done is set to 1.

In step 1203, a decision is made as to whether the rotational speed Ne of the internal combustion engine 1 is coincident with a second given rotational speed N2. The second given rotational speed N2 is set, for example to about 3000 rpm which is within a normally used range and at which the oil pressure is almost saturated. If the rotational speed agrees with the second given rotational speed N2, this holding current learning value is learned as a holding current learning value AL2 at the second given rotational speed (step 1204). At the same time, a flag F2 indicating that learning is done is set to 1. In step 1205, the difference between the holding current learning value AL1 at the first given rotational speed and the holding current learning value AL2 at the second given rotational speed is found as a holding current learning value difference ALsa.

The holding current learning value AL1 at the first given rotational speed, the identification flag F1, the holding current learning value AL2 at the second given rotational speed, the identification flag F2, and the holding current learning value difference ALsa are stored in the backup RAM of the control means 17. They are kept stored unless the battery is detached. The identification flags F1 and F2 are set to zero only immediately after the battery is detached.

Figure 13:
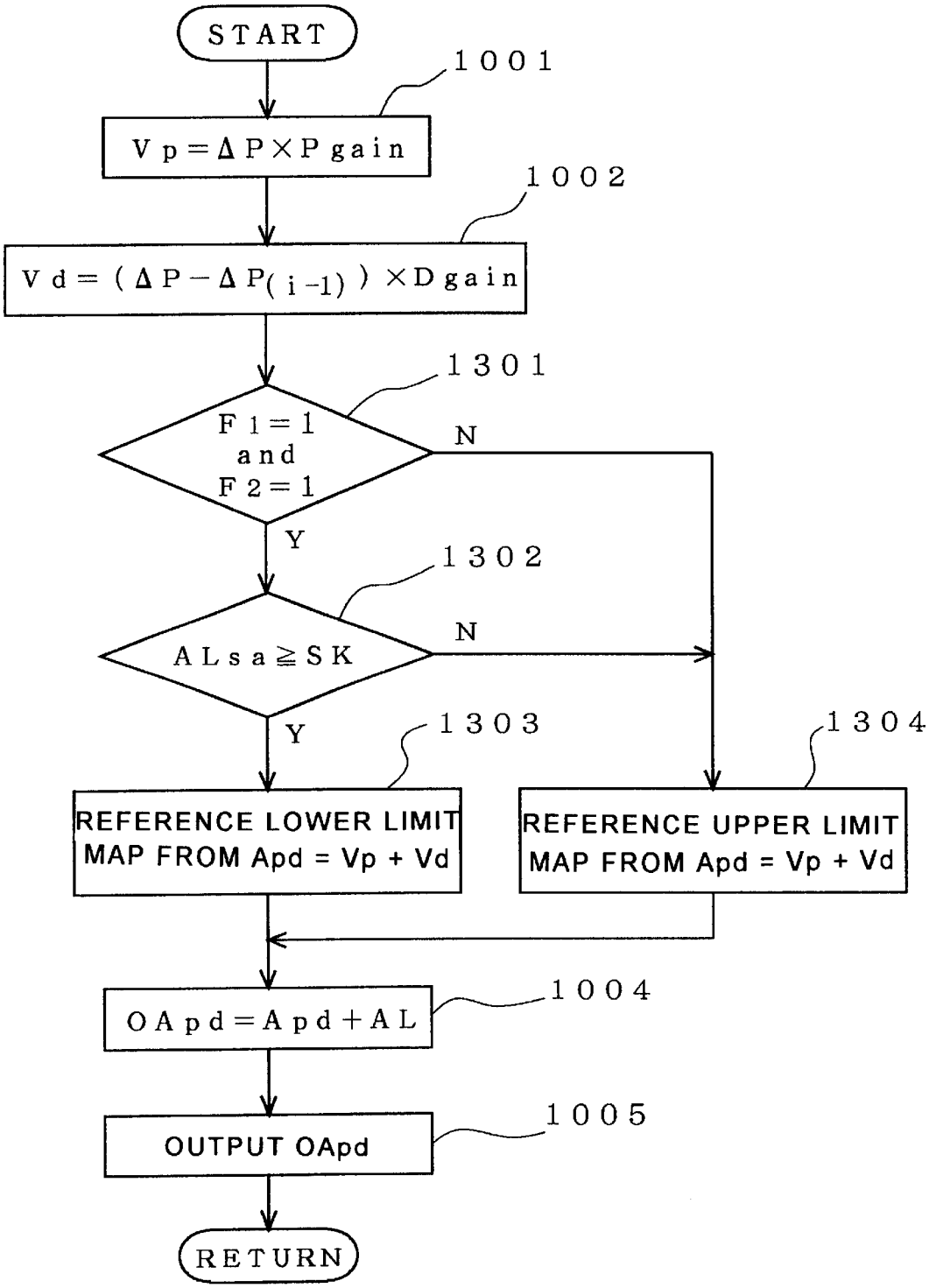
FIG. 13 is a flowchart illustrating control of the valve timing controller in accordance with Embodiment 1 of the invention, the valve timing controller being for use with an internal combustion engine.

FIG. 13 illustrates the processing carried out where the result of the decision made in the processing of FIG. 8 is that the mode is the proportional-and-derivative (PD) mode. The present invention is applied to the processing of FIG. 10. In steps 1001 and 1002, the proportional value and derivative value are calculated as mentioned previously, and then a decision is made as to whether learning of holding current learning values at the first and second given rotational speeds is completed (i.e., whether F1=1 and F2=1) (step 1301). If the learning is complete, a decision is made as to whether the holding current learning value difference ALsa is more than a given current value SK (step 1302). The given current value SK is set, for example, to a current difference value at which an oil pressure control valve (OCV) having a characteristic curve at the upper limit and an oil pressure control valve (OCV) having a characteristic curve at the lower limit can be discriminated. Usually, it is about 20 mA.

Where the holding current learning value difference ALsa is more than the given current value SK, a target current difference Apd is calculated from the sum of the proportional value Vp and the derivative value Vd (Vp+Vd) by interpolating, or making reference to, the angle advance speed-current value characteristic map for the oil pressure control valve (OCV) having the characteristic curve at the lower limit (step 1303). If the result of the decision made in step 1302 is that the holding current learning value difference ALsa is less than the given current value SK, control goes to step 1304, where the target current difference Apd is calculated from the sum of the proportional value Vp and the derivative value Vd by interpolating, or making reference to, the angle advance speed-current value characteristic map for the oil pressure control valve (OCV) having the characteristic curve at the upper limit. In step 1004, the holding current learning value AL is added to the target current difference Apd to find a target current value OApd. In step 1005, this is sent to the oil pressure control valve (OCV).

The map about the oil pressure control valve (OCV) having a characteristic curve at the lower limit is interpolated or referenced in step 1303. This characteristic is indicated by the solid line in FIG. 7. The map about the oil pressure control valve (OCV) having a characteristic curve at the upper limit is interpolated or referenced in step 1304. This characteristic is indicated by the solid line in FIG. 5. It is observed that the characteristic curve of the map about the product having a characteristic curve at the lower limit responds at a lower rate to variation of the electrical current than the characteristic curve of the map about the product having a characteristic curve at the upper limit, i.e., the gradient of the former curve is milder than the gradient of the latter curve. In step 1301, if holding current learning operations at the first and second given rotational speeds are not complete, a map corresponding to the upper limit is referenced in step 1304, because the output current is limited when the characteristics of the oil pressure control valve (OCV) are not yet known and thus emphasis is placed on safety. In this way, the response is controlled to a low rate for some time.

Figure 14:
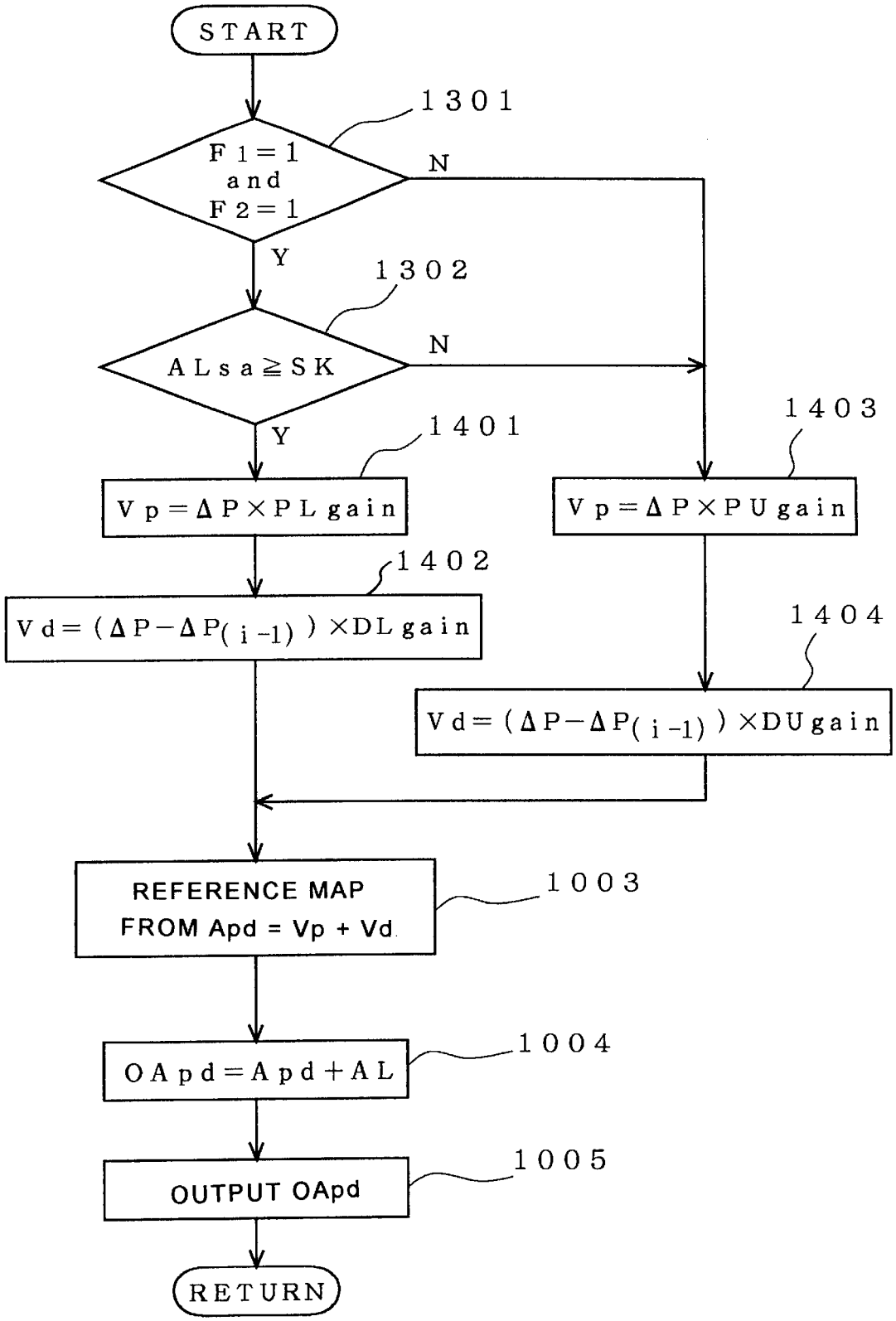
FIG. 14 is a flowchart illustrating control of the valve timing controller in accordance with Embodiment 1 of the invention, the valve timing controller being for use with an internal combustion engine.

In calculating the target current value of FIG. 13, the angle advance speed-current value characteristic map is switched according to the holding current learning value difference ALsa. Alternatively, as shown in FIG. 14, the proportional gain or derivative gain may be switched according to the holding current learning value difference ALsa and set. That is, as illustrated in FIG. 14, a decision is made as to whether the holding current learning operations at the first and second given rotational speeds are complete (step 1301). If the result of the decision made in step 1302 is that the holding current learning value difference ALsa is more than the given value SK, the proportional value Vp and derivative value Vd are calculated from the proportional gain PLgain and the derivative gain DLgain, respectively, which have been set for the oil pressure control valve (OCV) having a characteristic curve at the lower limit and stored in steps 1401 and 1402.

If the result of the decision made in step 1302 is that the holding current learning value difference ALsa is less than the given value SK, or if the result of the decision made in step 1301 is that the holding current learning operation is not yet completed, then control goes to steps 1403 and 1404, respectively, where the proportional value Vp and the derivative value Vd are calculated from proportional gain PUgain and derivative gain DUgain, respectively, set for an oil pressure control valve (OCV) having a characteristic curve at the upper limit. Subsequently, the angle advance speed-current value characteristic map is interpolated or referenced, based on the proportional value Vp and the derivative value Vd, to calculate the target current difference Apd (step 1003). With respect to the advanced angle-current value characteristic map used at this time, a value corresponding to an oil pressure control valve (OCV) having a medium characteristic curve is set, or a value satisfying the response of the valve timing control is set using the midway value of the characteristics, in the same way as in step 1003 of FIG. 10.

In step 1004, the target current value OApd is calculated. This value is delivered in step 1005. With respect to the proportional gain and derivative gain, gains PLgain and DLgain for the oil pressure control valve (OCV) having a characteristic curve at the lower limit are set higher than gains PUgain and DUgain for the OCV having a characteristic curve at the upper limit. The gain that is selected can be limited to only the proportional gain because of the relation between the holding current learning value difference ALsa and the given value SK; the derivative gain is maintained constant. Furthermore, the selected gain may be restricted to only the derivative gain; the proportional gain is held constant. If the holding current learning operations at the first and second given rotational speeds are not complete in step 1301, calculations are performed using the proportional gain and the derivative gain set for the oil pressure control valve (OCV) having a characteristic curve at the upper limit, because the output current is limited when the characteristics of the OCV are not yet known and emphasis is placed on safety. In this way, the response is controlled to a low rate for some time.

Figure 15:
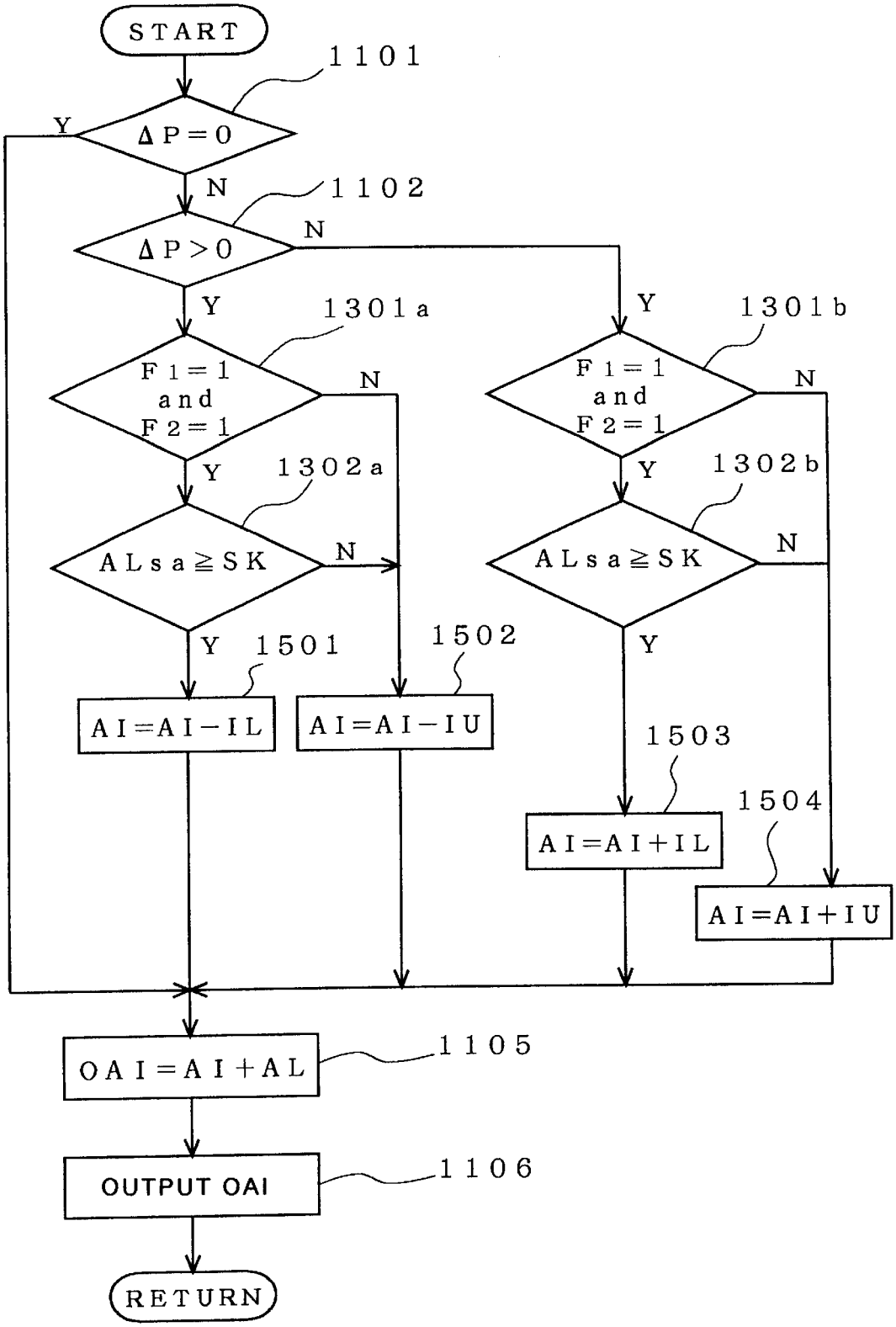
FIG. 15 is a flowchart illustrating control of the valve timing controller in accordance with Embodiment 1 of the invention, the valve timing controller being for use with an internal combustion engine.

FIG. 15 illustrates processing performed by applying this invention to the processing illustrated in FIG. 11. In this processing of FIG. 15, a decision is made as to whether the difference ΔP between the actual amount of advanced angle and the target amount of advanced angle is equal to zero (step 1101). If the result of the decision is NO (i.e., the difference is not equal to zero), control goes to step 1102, where a decision is made as to whether this difference ΔP is greater than zero. If the result of the decision is YES, control proceeds to step 1301*a*, where a decision is made as to whether holding current learning operations at the first and second given rotational speeds are complete. If the result of the decision is YES, control goes to step 1302*a*, where a decision is made as to whether the holding current learning value difference ALsa is equal to or more than the given value SK. If the result of the decision is YES, control goes to step 1501, where an integral value IL corresponding to an oil pressure control valve (OCV) having a characteristic value at the lower limit is subtracted from the integral value AI (AI=AI−IL). If the result of the decision made in step 1302*a* is NO (i.e., the holding current learning value difference ALsa is less than the given value SK), or if the result of the decision made in step 1301*a* is NO (i.e., the holding current learning operation is not complete), control goes to step 1502, where an integral value IU corresponding to an OCV having a characteristic curve at the lower limit is subtracted from the integral value AI.

If the result of the decision made in step 1102 is NO (i.e., the difference ΔP between the actual amount of advanced angle and the target amount of advanced angle is less than zero), control goes to step 1301*b*. If the result of the decision made in step 1301*b* is YES (i.e., the holding current learning operations at the first and second given rotational speeds are complete), control proceeds to step 1302*b*. If the result of the decision made in step 1302*b* is YES (i.e., the holding current learning value difference ALsa is more than the given value SK), control goes to step 1503, where the integral value IL corresponding to an OCV having a characteristic curve at the lower limit is added to the integral value AI (AI=AI+IL). If the result of the decision made in step 1302*b* is NO (i.e., the holding current learning value difference ALsa is less than the given value SK), or if the result of the decision made in step 1301*b* is NO (i.e., the holding current learning operations are not complete), control goes to step 1504, where an integral value IU corresponding to an oil pressure control valve (OCV) having a characteristic value at the upper limit is added to the integral value AI (AI=AI+IL). In this example, the integral value IL corresponding to an OCV having a characteristic value at the lower limit is set higher than the integral value IU corresponding to an OCV having a characteristic value at the upper limit. If the result of the decision made in step 1301*a* or 1301*b* is NO (i.e., the holding current learning operations at the first and second given rotational speeds are not complete), an integral value corresponding to the upper limit is added or subtracted, because the output current is limited when the characteristics of the OCV are not yet known and emphasis is placed on safety. In this way, the response is controlled to a low rate for some time.

As described thus far, in the valve timing controller built in accordance with Embodiment 1 of the present invention and for use with an internal combustion engine, a holding current learning value difference is found in a different operating state of the engine. The angle advance speed-current value characteristic map for PD control (i.e., execution of calculations in the PD mode) is selected according to this difference. The values of the proportional gain and of the derivative gain are switched according to the difference of the holding current learning value, and the angle advance speed-current value characteristic map is interpolated or referenced. Thus, the target current difference is found. Consequently, control processing is performed according to the characteristics of the used oil pressure control valve (OCV). Even if the response shows a variation, it can be reduced. Hence, stable response can be obtained. In addition, the integral value used for the integral control operation (in which calculations are carried out in the holding mode) is switched according to the difference of the holding current learning value. In consequence, variations in the valve timing control due to OCV characteristic variations can be reduced. This assures stable control.

Embodiment 2

FIGS. 16–19 are flowcharts illustrating the contents of control operations performed by a valve timing controller built in accordance with Embodiment 2 of the invention and for use with an internal combustion engine. This Embodiment 2 is similar to Embodiment 1 except that the contents of the control operations are modified to determine the current value used for valve timing control using a holding current learning value ratio. Note that those process steps which have been already described in Embodiment 1 are indicated by the same reference numerals as in the description of Embodiment 1 and will not be described in detail below.

Figure 16:
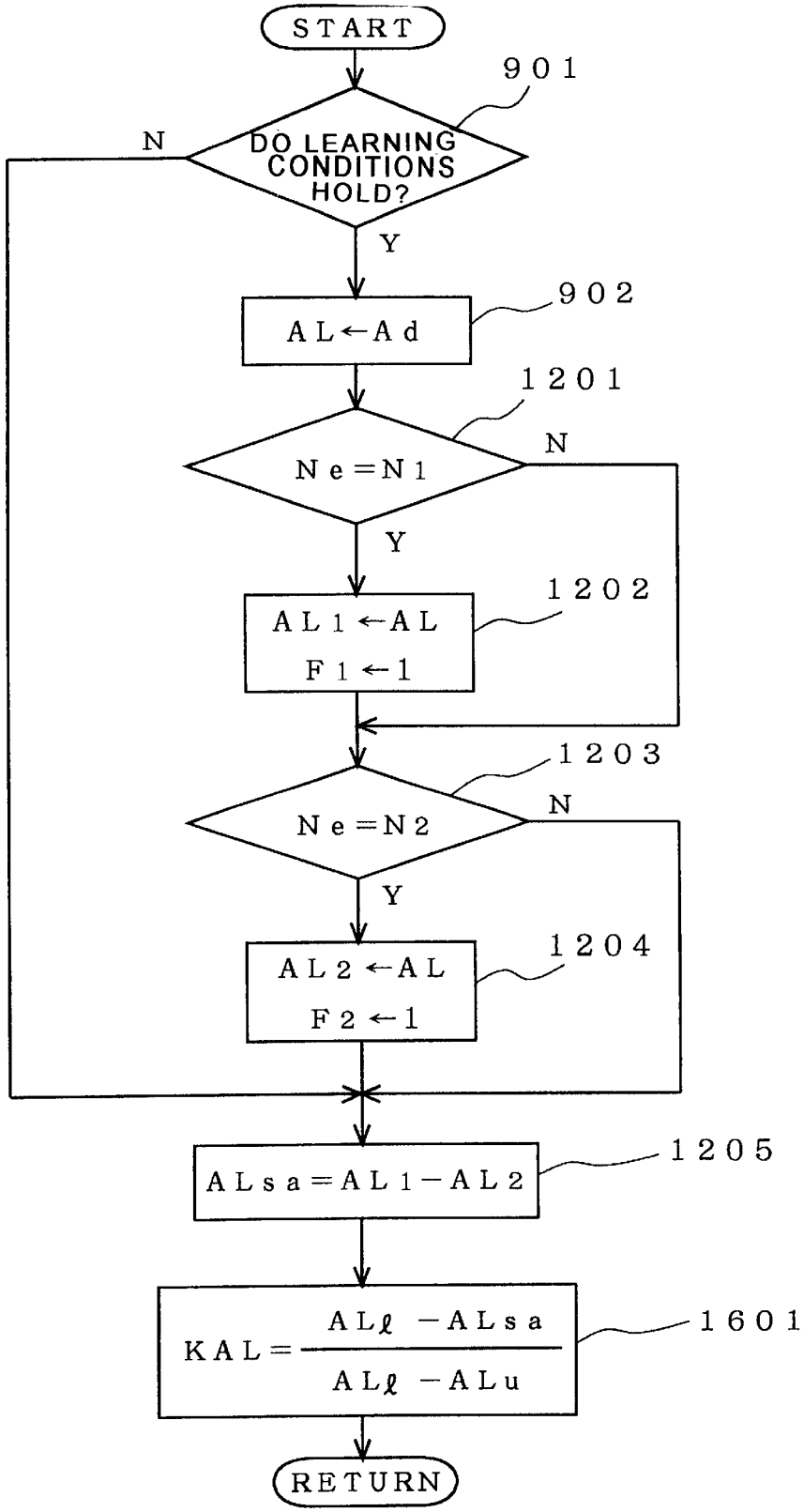
FIG. 16 is a flowchart illustrating control of a valve timing controller in accordance with Embodiment 2 of the invention, the valve timing controller being for use with an internal combustion engine.

FIG. 16 illustrates holding current learning processing that is similar to the processing described already in connection with FIG. 12 in the description of Embodiment 1 except that step 1601 is added. In FIG. 16, steps 901–1205 are the same as the processing of FIG. 12 in Embodiment 1. In steps 1201–1204, holding current learning value AL1 at the first given rotational speed and holding current learning value AL2 at the second given rotational speed are learned. Instep 1205, the difference between them is learned as the holding current learning value difference ALsa. Then, a holding current learning value ratio KAL is calculated from all of the holding current learning value difference ALsa, a holding current difference AL1, and a holding current difference ALu corresponding to an OCV having a characteristic curve at the upper limit (step 1601). The holding current difference AL1 corresponds to an OCV having a characteristic curve at the lower limit and is previously stored in the ROM.

Figure 17:
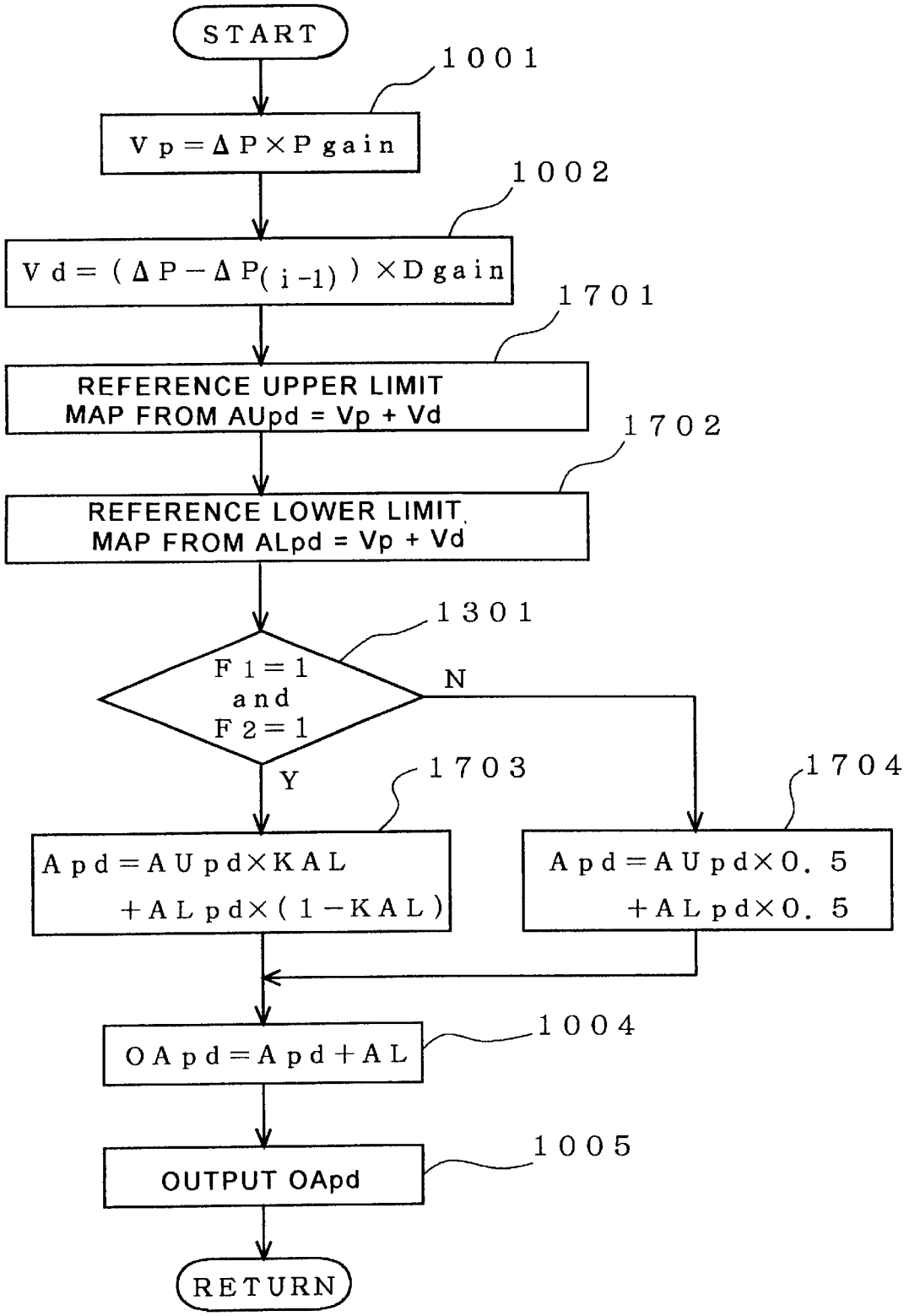
FIG. 17 is a flowchart illustrating control of the valve timing controller in accordance with Embodiment 2 of the invention, the valve timing controller being for use with an internal combustion engine.

FIG. 17 illustrates a proportional-and-derivative control operation executed in the PD mode and varies the contents of the control processing of FIG. 13 included in Embodiment 1. In step 1001, the proportional value Vp is calculated. In step 1002, the derivative value Vd is calculated. Then, control goes to step 1701, where a target current difference AUpd is found using the sum of Vp and Vd, from the angle advance speed-current value characteristic map corresponding to the upper limit. Control then proceeds to step 1702, where a target current difference ALpd is found using the sum of Vp and Vd, from the angle advance speed-current value characteristic map corresponding to the lower limit. Subsequently, control goes to step 1301, where a decision is made as to whether holding current learning operations at the first and second given rotational speeds are completed. If the result of the decision is YES (i.e., the control operations are complete), control goes to step 1703, where the target current difference Apd is calculated from all of the holding current learning value ratio KAL obtained in step 1601, the upper limit target current difference AUpd obtained in step 1701, and the lower limit target current difference ALpd obtained in step 1702.

If the result of the decision made in step 1301 is NO (i.e., the holding current learning operations are not complete), control goes to step 1704, where the midway value between the upper limit current difference AUpd and the lower limit target current difference ALpd is taken as the target current difference Apd. Control then proceeds to step 1004, where the target current value OApd is computed. This is sent to the oil pressure control valve (OCV) in step 1005. If the result of the decision made in step 1301 is NO (i.e., the holding current learning operations are not complete), control goes to step 1704, where the midway value is taken as the target current difference Apd, because the characteristics of the oil pressure control valve (OCV) are not yet known. Response comparable to the response obtained where this control is not utilized is secured by using a value corresponding to the midway value even if the characteristics are unknown.

Figure 18:
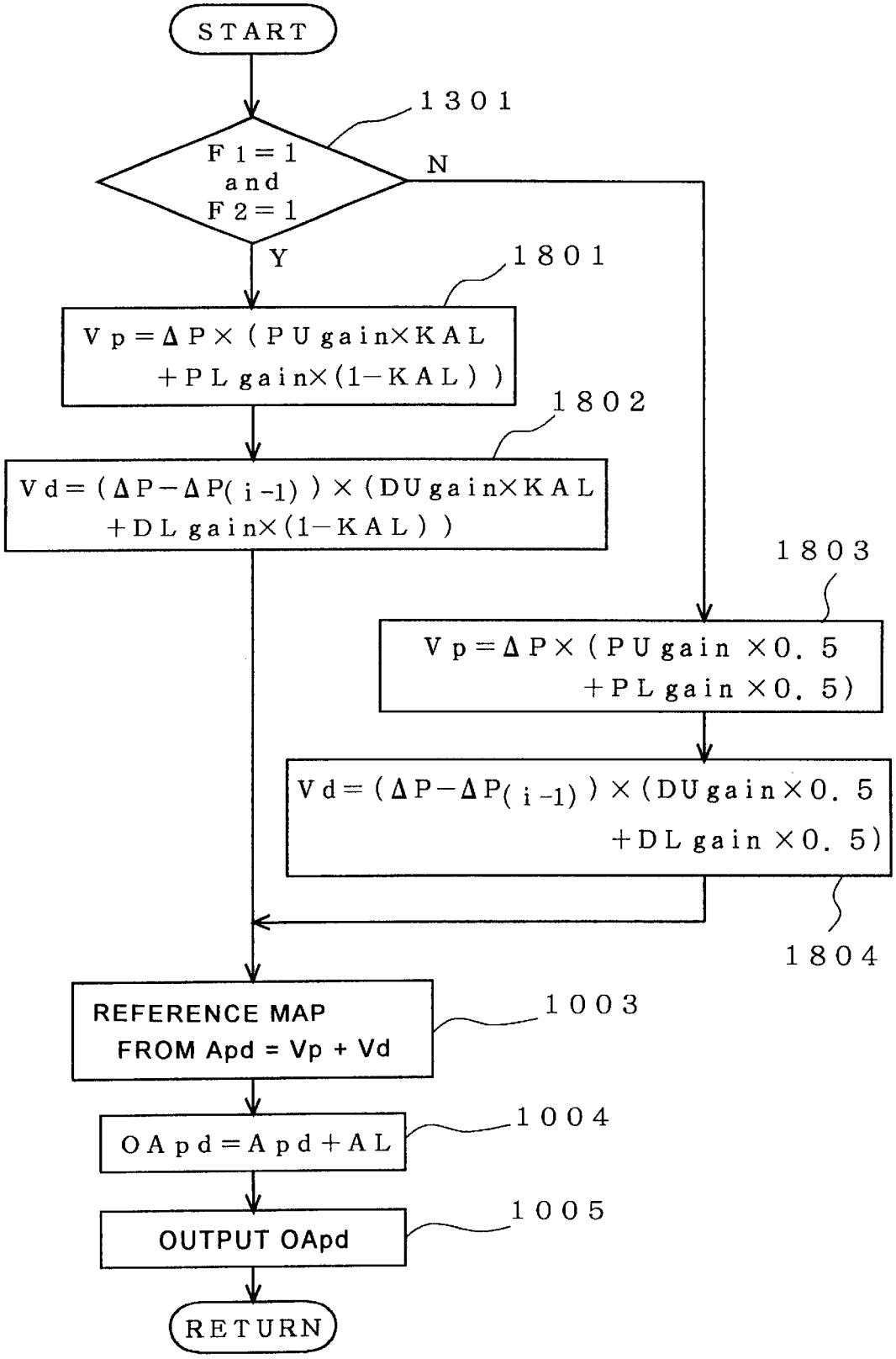
FIG. 18 is a flowchart illustrating control of the valve timing controller in accordance with Embodiment 2 of the invention, the valve timing controller being for use with an internal combustion engine.

Instead of the processing of FIG. 17, processing illustrated in FIG. 18 can be used. In FIG. 18, if the result of the decision made in step 1301 is YES (i.e., the holding current learning operations at the first and second given rotational speeds are complete), control goes to step 1801, where the proportional value Vp is found from all of the holding current learning value ratio KAL, the proportional gain PUgain for an OCV having a characteristic curve at the upper limit, and the proportional gain PLgain for an OCV having a characteristic curve at the lower limit. Then, in step 1802, the derivative value Vd is found from all of the holding current learning value ratio KAL, the derivative gain DUgain for an OCV having a characteristic curve at the upper limit, and the derivative gain DLgain for an OCV having a characteristic curve at the lower limit. If the result of the decision made in step 1301 is NO (i.e., the learning operations are not complete), control goes to step 1803, where the proportional value Vp is set to a midway value between the proportional gain Pugain for an OCV having a characteristic curve at the upper limit and the proportional gain PLgain for an oil pressure control valve (OCV) having a characteristic curve at the lower limit. Similarly, in step 1804, the derivative value Vd is set to a midway value between the derivative gain DUgain for an OCV having a characteristic curve at the upper limit and the derivative gain DLgain for an OCV having a characteristic curve at the lower limit.

Subsequently, in step 1003, the target current difference Apd is found based on the sum of the proportional value Vp and the derivative value Vd by interpolating, or making reference to, the angle advance speed-current value characteristic map. In this example, the angle advance speed-current value characteristic map is set to a characteristic value corresponding to an OCV having a medium characteristic curve in the same way as in step 1003 of FIG. 10. Control then goes to step 1004, where the holding current learning value AL is added to the target current difference Apd to calculate the target current value OApd. Control then proceeds to step 1005, where the value is sent to the oil pressure control valve (OCV). If the result of the decision made in step 1301 is NO (i.e., the holding current learning operations are not complete), control goes to step 1803, where the proportional value Vp is set to a midway value between the proportional gain for an OCV having a characteristic curve at the upper limit and the proportional gain for an OCV having a characteristic curve at the lower limit. Control then goes to step 1804, where the derivative value is set to a midway value between the derivative gain for an OCV having a characteristic curve at the upper limit and the derivative gain for an OCV having a characteristic curve at the lower limit, because the characteristics of the OCV are not yet known. Response comparable to the response obtained where this control is not utilized is secured by using a value corresponding to the midway value even if the characteristics are unknown.

Figure 19:
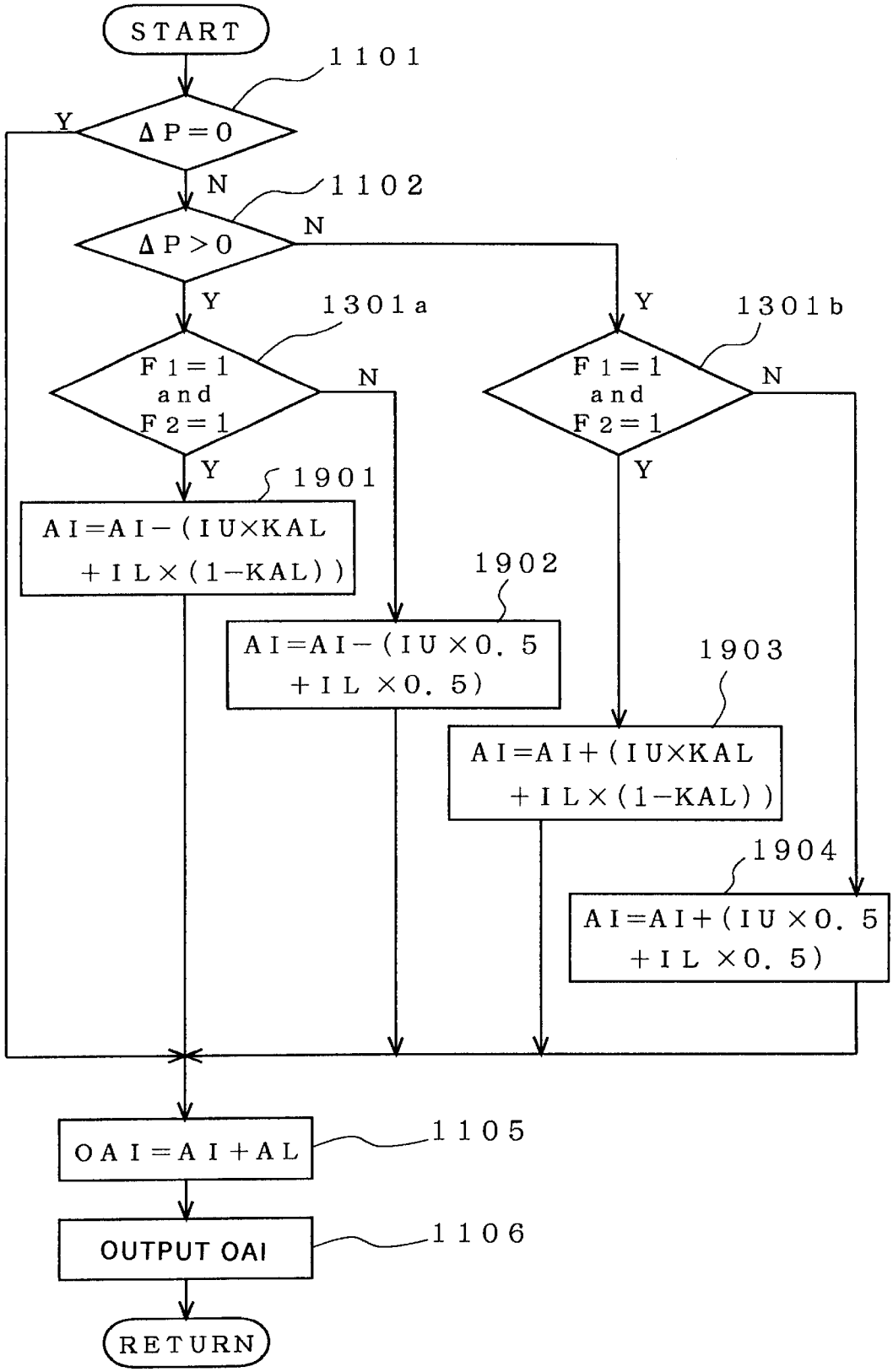
FIG. 19 is a flowchart illustrating control of the valve timing controller in accordance with Embodiment 2 of the invention, the valve timing controller being for use with an internal combustion engine.

Processing illustrated in FIG. 19 is a modification of the processing of FIG. 15 that has been already described in Embodiment 1. In FIG. 19, a decision is made as to whether the difference ΔP between the actual amount of advanced angle and the target amount of advanced angle is equal to zero (step 1101). If the result of the decision is NO (i.e., the difference is not equal to zero), control goes to step 1102, where a decision is made as to whether the difference ΔP between the actual amount of advanced angle and the target amount of advanced angle is greater than zero. If the result of the decision is YES, control proceeds to step 1301*a*, where a decision is made as to whether holding current learning operations at the first and second given rotational speeds are complete. If the result of the decision is YES, control proceeds to step 1901, where an integral amount found from the holding current learning value ratio KAL, the upper limit integral amount IU, and the lower limit integral amount IL is subtracted from the integral value AI. If the result of the decision made in step 1301*a* is NO (i.e., the learning operations are not complete), control goes to step 1902, where a midway value between the upper limit integral value IU and the lower limit integral value IL is taken as an integral value and subtracted from the integral value AI.

If the result of the decision made in step 1102 is NO (i.e., the difference ΔP between the actual amount of advanced angle and the target amount of advanced angle is less than zero), control goes to step 1301*b*, where a decision is made as to whether the holding current learning operations at the first and second given rotational speeds are complete. If the result of the decision is YES, control goes to step 1903, where the integral value found from the holding current learning value ratio KAL, the upper limit integral value IU, and the lower limit integral value IL is added to the integral value AI. If the result of the decision made in step 1301*b* is NO (i.e., the learning operations are not complete), control goes to step 1904, where a midway value between the upper integral value IU, and the lower integral value IL is taken as an integral value and added to the integral value AI. After obtaining the integral value AI by these steps, control goes to step 1105, where the holding current learning value AL is added to the integral value AI to find the target current value OAI. Control then goes to step 1106, where this target current value is delivered.

During this processing, if the result of the decision made in step 1301*a* is NO (i.e., the holding current learning operations are not complete), control goes to step 1902, where a midway value between the integral values for OCVs having characteristic curves at the upper and lower limits, respectively, is used in calculating the integral value. Similarly, if the result of the decision made in step 1301*b* is NO (i.e., the holding current learning operations are not complete), control goes to step 1904, where a midway value between the integral values for OCVs having characteristic curves at the upper and lower limits, respectively, is used in calculating the integral value, for the following reason. The characteristics of the used OCV are not yet found. Response comparable to the response obtained where this control is not utilized is secured by using a value corresponding to the midway value even if the characteristics are unknown.

As described thus far, in the valve timing controller built in accordance with Embodiment 2 of the present invention and for use with an internal combustion engine, the angle advance speed-current value characteristic map or the control gain for PD control is found using the holding current learning ratio. In the PD control, calculations are performed using the difference of the holding current learning value in the proportional-and-derivative (PD) mode. Furthermore, the integral value is calculated in the holding mode from the difference of the holding current learning value. Therefore, the control current value can be matched to the characteristics of the actually used oil pressure control valve (OCV) 16 regardless of the characteristics of the oil pressure control valve (OCV) 16. Hence, more stable response and controllability can be obtained than in Embodiment 1.

In both Embodiments 1 and 2, timing control of the intake valve is taken as an example. The present invention can be applied with equal utility to timing control of the exhaust valve.

As described thus far, claim 1 of the present application provides a valve timing controller for use with an internal combustion engine having a crankshaft, the valve timing controller comprising: an intake cam driven by the crankshaft of the engine and acting to open and close intake valves; an exhaust cam driven by the crankshaft of the engine and acting to open and close exhaust valves; a valve timing-varying means mounted in a rotation transfer path between the crankshaft and at least one cam selected from the intake valve and the exhaust valve of the cams to vary the phase of rotation of the cam relative to the crankshaft; a driving means for driving the valve timing-varying means; and a control means for controlling an amount of control over the driving means. This control means detects a difference of the amount of control over the driving means to cause the valve timing-varying means to operate in a desired manner under a different operating condition of the internal combustion engine. The amount of control over the driving means is determined according to the difference of the amount of control. The response characteristics of the oil pressure control valve (OCV) that is a mounted driving means are detected. Valve timing can be controlled according to the response characteristics. Stable response can be obtained.

In the valve timing controller according to this invention, the difference of the amount of control under a different operating condition of the engine is detected when the difference between an actually operated amount of motion to vary the valve timing and a target amount of motion to vary the valve timing satisfies a given condition. The amount of control can be found accurately according to the response characteristics of the mounted driving means.

In the valve timing controller according to this invention, the control means learns amounts of control under different operating conditions of the engine. The amount of control over the driving means is determined from a difference of this learned value. Therefore, when proportional and derivative control operations or an integral control operation is performed, an amount of control according to the response characteristics of the mounted driving means can be found precisely.

In the valve timing controller according this invention, the control means stores plural characteristics of the driving means. One of the plural characteristics is selected according to the difference of the amount of control under a different operating condition of the engine. Thus, the amount of control over the driving means is determined. Thus, the valve timing can be controlled using an amount of control adapted for the response characteristics of the mounted driving means. The system can be used under a high response condition.

In the valve timing controller according to this invention, the control means selects a poor response characteristic or control value from plural characteristics or control values until the amount of control over the driving means is determined from a difference of the amount of control under a different operating condition of the engine. The selected characteristic or control value is used as an amount of control over the driving means. Therefore, the valve timing can be controlled stablly until the control means finds the characteristics of the driving means.

In the valve timing controller according to this invention, proportional and derivative control operations are performed according to the difference between the detected relative position and the target position. Plural proportional and derivative control values are set. One of the proportional and derivative values is selected according to the difference of the amount of control under a different operating condition of the engine. Thus, the amount of control over the driving means is determined. Variations in response due to variations in the characteristics of the driving means can be reduced. The characteristic variations can be corrected by a control operation.

In the valve timing controller according to this invention, an integral operation is performed according to the difference between the detected relative position and the target position. Plural integral control values are set. One of the different integral control values is selected according to the difference of the amount of control under a different operating condition of the engine. Thus, the amount of control over the driving means is determined. Variations of the valve timing control due to variations in OCV characteristics can be reduced. Stable control is permitted.

In the valve timing controller according to this invention, the control means stores plural different characteristics of the driving means. The control means interpolates, or makes reference to, one of the plural different characteristics according to a difference in the amount of control under a different operating condition of the engine. Thus, the amount of control over the driving means is determined. Therefore, an amount of control adapted for the response characteristics of the mounted driving means can be calculated.

In the valve timing controller according to this invention, the amount of control over the driving means is calculated from each midway value obtained by interpolating, or making reference to, the plural characteristics or control values until the amount of control over the driving means is set from the difference of the amount of control under a different operating condition of the engine. Response comparable to the response obtained where this invention is not utilized can be secured until the control means finds the characteristics of the driving means. Simultaneously with finding of the characteristics, variations in valve timing control due to variations in characteristics of the driving means can be reduced. Also, the system can shift to a control mode having excellent response.

In the valve timing controller according to this invention, proportional and derivative control operations are performed according to the difference between each detected position of the angular position of each cam relative to the angular position of the crankshaft and the target position. Plural proportional and derivative control values are set. The control means interpolates, or makes reference to, one of the plural different characteristics according to the difference in the amount of control under a different operating condition of the engine. Thus, the amount of control over the driving means is calculated. Therefore, the amount of control can be set to a value suitable to the characteristics of the actually used driving means, regardless of the characteristics of the driving means. Hence, more stable response and controllability can be obtained.

In the valve timing controller according to this invention, an integral control operation is performed according to the difference between the detected angular position of each cam relative to the angular position of the crankshaft and the target position, and plural integral control values are set. The control means interpolates, or makes reference to, one of the different integral control values according to the difference in the amount of control under a different operating condition of the engine. The amount of control over the driving means is calculated. Therefore, variations in valve timing control due to variations in characteristics of the driving means can be reduced. More stable controllability can be obtained.

What is claimed is:

1. A valve timing controller for use with an internal combustion engine having a crankshaft, said valve timing controller comprising:

an intake cam driven by the crankshaft of said internal combustion engine and acting to open and close intake valves;

an exhaust cam driven by the crankshaft of said internal combustion engine and acting to open and close exhaust valves;

a valve timing-varying means mounted in a rotation transfer path between said crankshaft and at least one cam selected from the intake cam and the exhaust cam to vary phase of rotation of said one cam relative to the crankshaft;

a driving means for driving said valve timing-varying means; and a control means for controlling an amount of control over said driving means, said control means detecting a difference of the amount of control over the driving means to cause said valve timing-varying means to operate in a desired manner under different operating conditions of said internal combustion engine, said amount of control over the driving means being determined according to the difference of the amount of control.

2. The valve timing controller of claim 1, wherein the difference of the amount of control under a different operating condition of the engine is detected when the difference between an actually operated amount of motion to vary the valve timing and a target amount of motion to vary the valve timing satisfies a given condition.

3. The valve timing controller of claim 1, wherein said control means learns amounts of control under different operating conditions of the engine, and wherein the amount of control over the driving means is determined from a difference of this learned value.

4. The valve timing controller of claim 1, wherein said control means stores plural different characteristics of the driving means, and wherein one of the plural different characteristics is selected according to a difference of the amount of control under a different operating condition of the engine, whereby the amount of control over the driving means is determined.

5. The valve timing controller of claim 4, wherein said control means selects a poor response characteristic from plural characteristics until the amount of control over the driving means is determined from a difference in the amount of control under a different operating condition of the engine, and wherein said selected characteristic is used as an amount of control over the driving means.

6. The valve timing controller of claim 4, wherein said control means selects a poor response control value from control values until the amount of control over the driving means is determined from a difference in the amount of control under a different operating condition of the engine, and wherein said control value is used as an amount of control over the driving means.

7. The valve timing controller of claim 1, wherein (A) there are further provided detecting means for detecting angular position of said one cams relative to the crankshaft and an arithmetic means for calculating target position of the angular position of said one cams relative to the angular position of the crankshaft according to the operating conditions of the engine, (B) said control means performs proportional and derivative control operations according to the difference between the detected relative position and the target position and sets plural proportional and derivative control values, and (C) one of the proportional and derivative values is selected according to a difference of the amount of control under a different operating condition of the engine, whereby the amount of control over the driving means is determined.

8. The valve timing controller of claim 1, wherein (A) there are further provided detecting means for detecting the angular position of said one cam relative to the crankshaft and an arithmetic means for calculating target position of the angular position of said one cam relative to the angular position of the crankshaft according to the operating conditions of the engine, (B) said control means performs an integral operation according to the difference between the detected relative position and the target position and sets plural integral control values, and (C) one of the different integral control values is selected according to a difference of the amount of control under a different operating condition of the engine, whereby the amount of control over the driving means is determined.

9. The valve timing controller of claim 1, wherein said control means stores plural different characteristics of the driving means, and wherein said control means interpolates one of the plural different characteristics according to a difference of the amount of control under a different operating condition of the engine, whereby the amount of control over the driving means is calculated.

10. The valve timing controller claim 9, wherein said amount of control over the driving means is calculated from each midway value obtained by interpolating to the plural characteristics until the amount of control over the driving means is set from a difference of the amount of control under a different operating condition of the engine.

11. The valve timing controller claim 9, wherein said amount of control over the driving means is calculated from each midway value obtained by interpolating to the plural control values until the amount of control over the driving means is set from a difference of the amount of control under a different operating condition of the engine.

12. The valve timing controller of claim 1, wherein (A) there are further provided a detecting means for detecting the angular position of said one cam relative to the angular position of the crankshaft and an arithmetic means for calculating target position of the angular position of said one cam relative to the angular position of the crankshaft according to the operating conditions of the engine, (B) said control means performs proportional and derivative control operations according to the difference between each detected relative position and the detected target position, and (C) said control means sets plural proportional and derivative control values and interpolates one of the plural different characteristics according to a difference of the amount of control under a different operating condition of the engine, whereby the amount of control over the driving means is calculated.

13. The valve timing controller claim 1, wherein (A) there are provided a detecting means for detecting the position of said one cam relative to the angular position of the crankshaft and an arithmetic means for calculating a target position of the angular position of said one cam relative to the crankshaft according to the operating conditions of the internal combustion engine, (B) said control means performs an integral control operation according to the difference between each detected relative position and the target position, and (C) said control means sets plural different integral control values and interpolates one of the different integral control values according to a difference in the amount of control under a different operating condition of the engine, whereby said amount of control over the driving means is calculated.

* * * * *